US008874007B2

(12) United States Patent
Kawamura et al.

(10) Patent No.: US 8,874,007 B2
(45) Date of Patent: Oct. 28, 2014

(54) DEVELOPING UNIT AND ELECTROPHOTOGRAPHIC IMAGE FORMING APPARATUS

(71) Applicant: Canon Kabushiki Kaisha, Tokyo (JP)
(72) Inventors: Kunimasa Kawamura, Mishima (JP); Minoru Nakamura, Mishima (JP); Shohei Urushihara, Suntou-gun (JP); Masaki Yamada, Mishima (JP); Yasushi Katsuta, Susono (JP)
(73) Assignee: Canon Kabushiki Kaisha, Tokyo (JP)
( * ) Notice: Subject to any disclaimer, the term of this patent is extended or adjusted under 35 U.S.C. 154(b) by 0 days.
(21) Appl. No.: 14/075,410
(22) Filed: Nov. 8, 2013
(65) Prior Publication Data

US 2014/0064792 A1 Mar. 6, 2014

Related U.S. Application Data

(63) Continuation of application No. PCT/JP2012/006695, filed on Oct. 18, 2012.
(30) Foreign Application Priority Data

Jun. 27, 2012 (JP) ..... 2012-144346
Oct. 5, 2012 (JP) ..... 2012-223149

(51) Int. Cl.
*G03G 15/08* (2006.01)
*G03G 9/08* (2006.01)
*G03G 9/00* (2006.01)

(52) U.S. Cl.
CPC ..... *G03G 15/0806* (2013.01); *G03G 15/0818* (2013.01); *G03G 9/0821* (2013.01); *G03G 9/00* (2013.01)
USPC ..... 399/252; 399/286

(58) Field of Classification Search
USPC ..... 399/252, 286, 279; 430/108.1, 120.1, 430/123.5
See application file for complete search history.

(56) References Cited

U.S. PATENT DOCUMENTS 7,846,631 B2 12/2010 Katsuta et al.
8,182,405 B2 5/2012 Kurachi et al.
8,660,472 B2 * 2/2014 Kurachi et al. ..... 399/286

FOREIGN PATENT DOCUMENTS

JP 2005-141192 A 6/2005
JP 2009-75383 A 4/2009

(Continued)

OTHER PUBLICATIONS

PCT International Search Report and Written Opinion of the International Searching Authority, International Application No. PCT/JP2012/006695, Mailing Date Nov. 20, 2012.

*Primary Examiner* — Sophia S Chen
(74) *Attorney, Agent, or Firm* — Fitzpatrick, Cella, Harper and Scinto

(57) ABSTRACT

Provided are a developing unit alleviating fogging occurrence and an electrophotographic image forming apparatus providing images over long periods. The developing unit includes at least a toner of (1) and a developing roller of (2). (1) When a displacement amount when a load is applied at Y° C. and $9.8\times10^{-5}$ N/sec to $2.94\times10^{-4}$ N is $X_{2(Y)}$, a displacement amount when the toner is left to stand for 0.1 second is $X_{3(Y)}$, a displacement amount when the load is reduced at $9.8\times10^{-5}$ N/sec to 0N is $X_{4(Y)}$, and percentage of $(X_{3(Y)}-X_{4(Y)})$ to $X_{3(Y)}$ is Z(Y), $40\leq Z(25)\leq 80$ and $10\leq Z(50)\leq 55$ are satisfied; when a gradient from the origin to the maximum load in the load-displacement curve at 25° C. is R(25), $0.49\times10^{-3}\leq R(25)\leq 1.70\times10^{-3}$ is satisfied; the toner has glass transition temperature TgA (40° C.-60° C.) and maximum endothermic peak temperature P1 (70° C.-110° C.), 15° C.≤(P1−TgA)≤70° C. is satisfied. (2) The developing roller includes a surface layer containing a urethane resin having structure (a), and one or both structures (b)-(c).

Structural formula (a)

Structural formula (b)

Structural formula (c)

5 Claims, 4 Drawing Sheets

(56) References Cited

FOREIGN PATENT DOCUMENTS

| | | | |
|---|---|---|---|
| JP | 2009-109861 | A | 5/2009 |
| JP | 2009-244658 | A | 10/2009 |
| JP | 2010-107968 | A | 5/2010 |
| JP | 2011-74217 | A | 4/2011 |
| WO | 2009/044726 | A1 | 4/2009 |

* cited by examiner

DEVELOPING UNIT AND ELECTROPHOTOGRAPHIC IMAGE FORMING APPARATUS

CROSS-REFERENCE TO RELATED APPLICATIONS

This application is a continuation of International Application No. PCT/JP2012/006695, filed Oct. 18, 2012, which claims the benefit of Japanese Patent Application No. 2012-144346, filed Jun. 27, 2012, and Japanese Patent Application No. 2012-223149, filed Oct. 5, 2012.

BACKGROUND OF THE INVENTION

1. Field of the Invention

The present invention relates to a developing unit to be used in an electrophotographic image forming apparatus and to an electrophotographic image forming apparatus.

2. Description of the Related Art

In an electrophotographic image forming apparatus, a developing unit serves to supply toner on a developing roller to an electrostatic latent image on an electrophotographic photosensitive member to form a toner image. The developing roller is rotationally driven while a toner regulating member is brought into abutment therewith, and a toner layer whose toner charge quantity has been controlled is formed on the developing roller.

In association with the development of a computer and multimedia, process for outputting a high-definition full-color image has been demanded in a wide variety of fields ranging from offices to households in recent years. Accordingly, additional improvements in speed, image quality, and durability have been required. In the developing unit, the developing roller and the toner have been improved for suppressing a reduction in developability due to the deformation of the toner caused by a stress which the toner receives in the developing unit.

For example, the following technology has been disclosed (Japanese Patent Application Laid-Open No. 2005-141192). Flexibility is imparted to the developing roller by forming a surface layer having a polyurethane obtained by polymerizing a polyurethane polyol prepolymer and an isocyanate compound, and hence the stress to be applied to the toner is reduced.

Meanwhile, the following toner particles each having a core-shell structure are preferably used in the toner for preventing the reduction of the developability due to the deformation of the toner caused by the stress which the toner receives in the developing unit. The vicinities of the surfaces of the toner particles are relatively hard and the insides of the toner particles are soft. Among others, the following toner particles have been disclosed (WO 09/044,726 A). The toner particles each have large toughness against an external factor at the time of the pressurization of the toner as a result of an improvement in adhesiveness between the core portion and shell layer of the core-shell structure.

SUMMARY OF THE INVENTION

When the inventors of the present invention have continuously formed electrophotographic images under an environment having a temperature as low as, for example, 5° C. by combining such developing roller and toner, development that is so called "fogging" has occurred in some cases, in which a portion of an electrophotographic image where no toner image is formed in essence is developed with the toner.

In view of the foregoing, the present invention is directed to providing a developing unit capable of alleviating the occurrence of fogging in an electrophotographic image when the electrophotographic image is formed in a low-temperature environment.

Further, the present invention is directed to providing an electrophotographic image forming apparatus capable of stably providing images over a long time period.

According to one aspect of the present invention, there is provided a developing unit, comprising at least: a toner of (1); a developing roller of (2); and a toner regulating member for controlling a toner amount on a surface of the developing roller:

(1) a toner, comprising:

toner particles each containing at least a binder resin, a coloring agent, and a wax component; and an inorganic fine powder, wherein:

when a displacement amount (μm) obtained when a load is applied to one particle of the toner at a temperature of Y° C. and at a loading rate of $9.8\times10^{-5}$ N/sec, and the load is reached at a maximum load of $2.94\times10^{-4}$ N, is defined as a displacement amount $X_{2(Y)}$, a displacement amount (μm) obtained when, after the load has reached the maximum load, the particle is left to stand under the maximum load for 0.1 second, is defined as a maximum displacement amount $X_{3(Y)}$, a displacement amount (μm) obtained when, after the standing for 0.1 second, the load is reduced at an unloading rate of $9.8\times10^{-5}$ N/sec, and then the load is reached at 0 N, is defined as a displacement amount $X_{4(Y)}$, a difference between the maximum displacement amount $X_{3(Y)}$ and the displacement amount $X_{4(Y)}$, is defined as an elastic displacement amount $X_{3(Y)}-X_{4(Y)}$), and a percentage of the elastic displacement amount ($X_{3(Y)}-X_{4(Y)}$) to the maximum displacement amount $X_{3(Y)}$, $\{(X_{3(Y)}-X_{4(Y)})/X_{3(Y)}\}\times100$, is defined as Z(Y) (%), Z(25), Z(Y) at the temperature Y is 25° C., satisfies a relationship of $40\leq Z(25)\leq80$, and Z(50), Z(Y) at the temperature Y is 50° C., satisfies a relationship of $10\leq Z(50)\leq55$;

in a load-displacement curve of which a displacement amount of the toner versus the load thereon at a temperature of 25° C. is plotted, when a gradient of the load-displacement curve from an origin to a point at which the load reaches the maximum load, is defined as R(25) (N/μm), $2.94\times10^{-4}$/displacement amount $X_{2(25)}$, R(25) satisfies a relationship of $0.49\times10^{-3}\leq R(25)\leq1.70\times10^{-3}$;

having a glass transition temperature (TgA) of 40° C. or more and 60° C. or less, and a peak temperature (P1) of a maximum endothermic peak of 70° C. or more and 110° C. or less; and satisfying a relationship of 15° C.≤(P1−TgA)≤70° C.; and (2) a developing roller, comprising:

a mandrel;

an elastic layer formed on a periphery of the mandrel; and a surface layer containing a urethane resin, the surface layer coating a peripheral surface of the elastic layer, wherein the urethane resin has, between two adjacent urethane bonds, a structure represented by the following structural formula (a), and one or both of structures selected from a structure represented by the following structural formula (b) and a structure represented by the following structural formula (c).

Structural formula (a)

$$-CH_2-CH_2-CH_2-CH_2-O-$$

Structural formula (b)

$$-CH_2-\underset{}{\overset{CH_3}{\overset{|}{CH}}}-CH_2-CH_2-O-$$

Structural formula (c)

$$-CH_2-CH_2-\overset{CH_3}{\overset{|}{CH}}-CH_2-O-$$

According to another aspect of the present invention, there is provided an electrophotographic image forming apparatus, comprising: an image bearing member for bearing an electrostatic latent image; a charging unit for charging the image bearing member; an exposing unit for forming the electrostatic latent image on the charged image bearing member; a developing unit for developing the electrostatic latent image with toner to form a toner image; and a transferring unit for transferring the toner image onto a transfer material, wherein the developing unit comprises the above-described developing unit.

According to the present invention, there is provided the developing unit capable of alleviating the occurrence of fogging resulting from an insufficient charge quantity of toner in a low-temperature environment.

Further, according to the present invention, provided is the electrophotographic image forming apparatus capable of stably providing images over a long time period.

DESCRIPTION OF THE EMBODIMENTS

Figure 1:
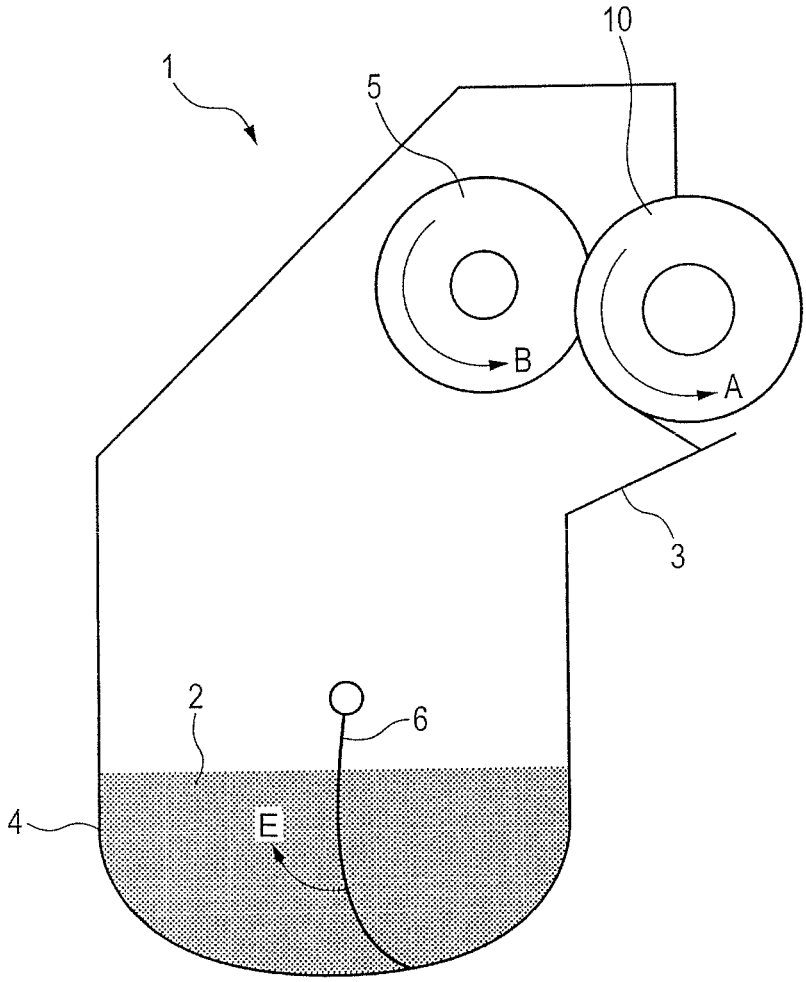
FIG. 1 is a schematic construction view illustrating an example of a developing unit according to the present invention.

As described in the foregoing, the inventors of the present invention have found that the occurrence of fogging in an electrophotographic image resulting from an insufficient charge quantity of toner in a low-temperature environment can be alleviated with the developing unit having at least the toner of (1), the developing roller of (2), and the toner regulating member for controlling a toner amount on the surface of the developing roller. Thus, the inventors have completed the present invention.

That is, the toner of (1) is a toner, including toner particles each containing at least a binder resin, a coloring agent, and a wax component, and an inorganic fine powder, in which: in a microcompression test on the toner, when a displacement amount (μm) obtained when a load is applied to one particle of the toner at a measuring temperature of Y° C. and a loading rate of $9.8\times10^{-5}$ N/sec and then reaches a maximum load of $2.94\times10^{-4}$ N is defined as a displacement amount $X_{2(Y)}$, a displacement amount (μm) obtained when, after the load has reached the maximum load, the particle is left to stand under the maximum load for 0.1 second is defined as a maximum displacement amount $X_{3(Y)}$, a displacement amount (μm) obtained when, after the standing for 0.1 second, the load is reduced at an unloading rate of $9.8\times10^{-5}$ N/sec and then the load becomes 0 N is defined as a displacement amount $X_{4(Y)}$, a difference between the maximum displacement amount $X_{3(Y)}$ and the displacement amount $X_{4(Y)}$ is defined as an elastic displacement amount $(X_{3(Y)}-X_{4(Y)})$, and a percentage $[\{(X_{3(Y)}-X_{4(Y)})/X_{3(Y)}\}\times100$: recovery ratio] of the elastic displacement amount $(X_{3(Y)}-X_{2(Y)})$ to the maximum displacement amount $X_{3(Y)}$ is defined as Z(Y) (%), Z(25) when the measuring temperature Y is 25° C. satisfies a relationship of $40\leq Z(25)\leq80$, and Z(50) when the measuring temperature Y is 50° C. satisfies a relationship of $10\leq Z(50)\leq55$; in a load-displacement curve obtained by plotting the load on the toner in the microcompression test at a measuring temperature of 25° C. and a displacement amount thereof, when a gradient of the load-displacement curve from an origin to a point at which the load reaches the maximum load is defined as R(25) [$2.94\times10^{-4}$/displacement amount $X_{2(25)}$)] (N/μm), R(25) satisfies a relationship of $0.49\times10^{-3}\leq R(25)\leq1.70\times10^{-3}$; the toner has a glass transition temperature (TgA) measured with a differential scanning calorimeter (DSC) of 40° C. or more and 60° C. or less, and a peak temperature (P1) of a maximum endothermic peak of 70° C. or more and 110° C. or less; and the peak temperature (P1) of the maximum endothermic peak and the glass transition temperature (TgA) satisfy a relationship of 15° C.≤(P1−TgA)≤70° C.

In addition, the developing roller of (2) is a developing roller, including a mandrel, an elastic layer formed on a periphery of the mandrel, and a surface layer containing a urethane resin, the surface layer coating a peripheral surface of the elastic layer, in which the urethane resin has, between two adjacent urethane bonds, a structure represented by the following structural formula (a), and one or both of structures selected from a structure represented by the following structural formula (b) and a structure represented by the following structural formula (c).

Structural formula (a)

$$-CH_2-CH_2-CH_2-CH_2-O-$$

Structural formula (b)

$$-CH_2-\overset{CH_3}{\overset{|}{CH}}-CH_2-CH_2-O-$$

Structural formula (c)

$$-CH_2-CH_2-\overset{CH_3}{\overset{|}{CH}}-CH_2-O-$$

The charge quantity of the toner to be carried by the developing roller depends on the magnitude of the area of contact between the developing roller and the toner at the abutment portion of the toner regulating member for controlling the toner amount. Accordingly, in a combination of a developing roller having a surface layer containing a resin that is liable to crystallize in a low-temperature environment and toner particles with improved toughness, the area of contact is liable to be insufficient in the low-temperature environment and the charge quantity of the toner tends to be liable to reduce. Further, the charge quantity gradually reduces owing to the falling or embodiment of an external additive on the surface of the toner caused by a stress which the toner receives from the abutting member in the developing unit. Accordingly, it is assumed that fogging becomes liable to occur particularly when the remaining amount of the toner reduces.

In view of the foregoing, the inventors of the present invention have investigated the use of a developing roller provided with a surface layer, which does not lose its flexibility even in a low-temperature region as a result of containing a polyurethane that hardly crystallizes even in the low-temperature region, in a developing unit together with a toner of (1) having toner particles with improved toughness.

As a result, the inventors have found that the area of contact between the toner and the developing roller is sufficiently secured even in the low-temperature region, and hence the occurrence of fogging in an electrophotographic image resulting from an insufficient charge quantity of the toner can be effectively suppressed.

In addition, at the same time, the inventors have found that the developing unit of the present invention can alleviate the occurrence of an image harmful effect called filming in which the toner sticks to the surface of the developing roller in the low-temperature environment to develop a halftone image in a partially dense manner.

This may be because of the following reason. The combination of the toner particles with improved toughness and the surface layer whose elastic modulus in the low-temperature region hardly increases can alleviate the stress which the toner on the surface of the developing roller receives from the abutting member in the low-temperature environment. As a result, the squashing and sticking of the toner to the surface of the developing roller are suppressed.

<Toner>

In the toner, the reduction of its fixation temperature is strongly required from the viewpoint of energy savings simultaneously with the improvement of its durability. Accordingly, such design that the viscoelasticity or melt viscosity of the toner is controlled for achieving compatibility between its durability and fixability is performed.

In general, the toner receives a mechanical frictional force in the developing unit to deteriorate. Accordingly, it is advantageous to improve the viscoelasticity or melt viscosity of the toner. On the other hand, however, the viscoelasticity or melt viscosity of the toner must be reduced in a fixing step in order that low-temperature fixation and image glossiness may be realized while an energy consumption is curtailed. In addition, reducing the viscoelasticity or melt viscosity of the toner not only is disadvantageous to its development characteristic or transfer characteristic but also reduces the storage stability of the toner under an environment having a temperature around 50° C. Meanwhile, in the fixing step, it is preferred that the wax component in a toner particle instantaneously bleed with ease (bleeding property) because the releasability of the toner with a fixing roller improves. However, when the wax component bleeds in a developing step, faulty charging of the toner due to the wax component may deteriorate its developability. As described above, in general, the durability and the fixability become mutually contradictory performances.

In view of the foregoing, the compatibility between the durability and the fixability is preferably achieved by considering design of the internal structure of a toner particle. In that case, hardness per one particle of the toner measured by a microcompression test serves as an effective indicator. The hardness per one particle of the toner represents the degree of deformation (elastic or plastic) of a toner particle and also serves as an effective indicator representing the degree of deformation of the toner at the abutment portion of the developing roller and the toner regulating member.

In the present invention, when the values for the Z(25), the Z(50), and the R(25) satisfy the relationships, a toner particle adopts a structure having a shell layer with optimum hardness. Accordingly, the durability improves and hence the image detrimental effect called filming can be alleviated. Simultaneously, a core portion can be designed so as to be sufficiently soft and hence an improvement in low-temperature fixability can also be realized.

In addition, when the values for the R(25), the P1, and the (P1−TgA) satisfy the relationships, the bleeding property of the wax component at the time of the heating and pressurization of the toner is enhanced, and hence the storage stability improves while the bleeding of the wax component is promoted at the time of fixation. Accordingly, the low-temperature fixability, anti-winding property, and storage stability of the toner can be improved.

Further, when the values for the TgA and the Z(25) satisfy the relationships, the adhesive force of the binder resin to a transfer material at the time of the heating and pressurization of the toner can be additionally increased. Accordingly, the low-temperature fixability of the toner can be improved.

The microcompression test on the toner in the present invention is performed by applying a small load of up to $2.94\times10^{-4}$ N to one particle of the toner, and the hardness and recovery ratio of the vicinity of the surface of the toner are mainly observed.

The toner of the present invention is such that in a load-displacement curve obtained by plotting a load and displacement amount in the microcompression test on the toner at a measuring temperature of 25° C., when the gradient of the load-displacement curve from the origin to the point at which the load reaches the maximum load is defined as R(25), R(25) satisfies a relationship of $0.49\times10^{-3}\leq R(25)\leq1.70\times10^{-3}$. That is, in the toner of the present invention, the value for the R(25) is an indicator representing the hardness of the vicinity of the surface layer of the toner at a temperature of 25° C. When the value for the R(25) is $0.49\times10^{-3}$ N/μm or more, the collapse or deformation of the toner caused by the stress which the toner receives in the developing unit is suppressed, and hence its developability and transferability can be improved. In contrast, when the value for the R(25) is $1.70\times10^{-3}$ N/μm or less, the vicinity of the surface layer of the toner becomes hard and the chipping of the toner caused by a slight load due to brittleness thereof can be suppressed. Accordingly, the durability can be improved and the low-temperature fixability can also be improved.

In addition, the toner of the present invention is such that in the microcompression test on the toner, when a displacement amount (μm) obtained when a load is applied to one particle of the toner at a measuring temperature of Y° C. and a loading rate of $9.8\times10^{-5}$ N/sec and then reaches a maximum load of $2.94\times10^{-4}$ N is defined as a displacement amount $X_{2(Y)}$, a displacement amount (μm) obtained when, after the load has reached the maximum load, the particle is left to stand under the maximum load for 0.1 second is defined as a maximum displacement amount $X_{3(Y)}$, a displacement amount (μm) obtained when, after the standing for 0.1 second, the load is reduced at an unloading rate of $9.8\times10^{-5}$ N/sec and then the load becomes 0 N is defined as a displacement amount $X_{4(Y)}$, a difference between the maximum displacement amount $X_{3(Y)}$ and the displacement amount $X_{4(Y)}$ is defined as an elastic displacement amount $(X_{3(Y)}-X_{4(Y)})$, and a percentage $[\{(X_{3(Y)}-X_{4(Y)})/X_{3(Y)}\}\times100$: recovery ratio] of the elastic displacement amount ($X_{3(Y)}-X_{4(Y)}$) to the maximum displacement amount $X_{3(Y)}$ is defined as Z(Y) (%), Z(25) when the measuring temperature Y is 25° C. satisfies a relationship of $40 \leq Z(25) \leq 80$.

The value for the Z(25) represents the degree to which the surface layer of the toner returns to its original state when the unloading is performed after the application of the maximum load at a measuring temperature of 25° C. When the value for the Z(25) is 40 or more, a state where the toner becomes liable to deform owing to the stress which the toner receives in the developing unit is suppressed, and hence the reductions of the developability and the transferability are easily suppressed. In addition, a state where the vicinity of the surface layer of the toner becomes excessively soft is suppressed, a state where the toner becomes liable to migrate toward the surface of a fixing roller in the fixing step is suppressed, and the high-temperature offset resistance can be improved. Meanwhile, when the value for the Z(25) is 80 or less, the vicinity of the surface layer of the toner can be prevented from becoming so hard as to hardly deform. As a result, a reduction in bleeding property of the wax component is suppressed in the fixing step, the offset of the toner at low temperatures is prevented, and the low-temperature fixability can be improved. In addition, a reduction in image glossiness is easily suppressed. In addition, the surface of a toner particle hardly deforms. Accordingly, the external additive hardly adheres to the surface of the toner particle, and the external additive on the surface of the toner becomes liable to be liberated when images are printed out on a large number of sheets, with the result that the developability and the transferability tend to reduce. Further, the value for the Z(25) is more preferably 45 or more and 70 or less from the viewpoint of the low-temperature fixability.

Further, the arithmetic average of the $X_{2(25)}$'s of the toner of the present invention is preferably 0.20 μm or more and 0.60 μm or less in order that the compatibility between the durability and the fixability may be achieved. Meanwhile, the arithmetic average of the $X_{3(25)}$'s thereof is preferably 0.22 μm or more and 0.65 μm or less.

The toner satisfying such requirements of the R(25) and the Z(25) as described above is the following toner. The vicinity of the surface of a toner particle is relatively hard and the inside of the toner particle is soft. A toner particle having a core-shell structure is suitably adopted for obtaining such toner.

The values for the R(25) and the Z(25) can be caused to satisfy the relationships by employing, for example, the following approach, but such approach is not limited to the following approach.

(1) When the toner particles are produced in an aqueous dispersion medium, a shell layer made of a polar resin to be described later is formed by incorporating the resin into each of the toner particles. Further, the polar resin is selected in consideration of its compatibility with the binder resin that forms a core portion.

(2) After the production of the core particles of the toner particles in the aqueous dispersion medium, the shell layer is formed by adding a monomer that constitutes the resin into the medium and subjecting the monomer to seed polymerization.

(3) Polar resin fine particles having a smaller volume average particle diameter than that of the core particles are mechanically caused to adhere to the core particles. Alternatively, the polar resin fine particles having a smaller volume average particle diameter are caused to adhere to the core particles by agglomeration in the aqueous dispersion medium. Then, the particles are stuck by heating.

In addition, the toner of the present invention is preferably such that Z(50) when the measuring temperature Y in the microcompression test on the toner is 50° C. satisfies a relationship of $10 \leq Z(50) \leq 55$. When the Z(50) falls within the range, the toner can exert high bleeding property even with instantaneous heat in the fixing step, and hence the low-temperature fixability can be additionally improved. In addition, the Z(50) preferably satisfies a relationship of $20 \leq Z(50) \leq 50$ and more preferably satisfies a relationship of $30 \leq Z(50) \leq 50$.

Further, in the toner of the present invention, $X_{2(50)}$ is preferably 0.05 μm or more and 0.45 μm or less, and $X_{3(50)}$ is preferably 0.10 μm or more and 0.50 μm or less in order that the compatibility between the durability and the fixability may be achieved.

The Z(50) can satisfy the range by regulating, for example, the glass transition temperature or weight average molecular weight of the polar resin or of the binder resin of the toner, or the addition amount of a crosslinking agent.

Further, in the present invention, in order that good fixability may be achieved, the glass transition temperature (TgA) of the toner measured with a differential scanning calorimeter (DSC) needs to be 40° C. or more and 60° C. or less, and is preferably 40° C. or more and 55° C. or less.

In addition, the peak temperature (P1) of the maximum endothermic peak of the toner measured with a differential scanning calorimeter (DSC) is 70° C. or more and 110° C. or less, preferably 70° C. or more and 90° C. or less, more preferably 70° C. or more and 85° C. or less.

When the TgA is 40° C. or more and 60° C. or less, the adhesive force of the toner to paper in low-temperature fixation increases and hence the low-temperature fixability improves. Meanwhile, when the P1 is 70° C. or more and 110° C. or less, the anti-winding property at high temperatures improves by virtue of moderate bleeding property of the wax component. Further, the plastic effect of the toner based on the wax component increases the adhesive force to paper, thereby improving the low-temperature fixability.

Further, the P1 and the TgA preferably satisfy a relationship of 15° C.≤(P1−TgA)≤70° C. The P1 and the TgA more preferably satisfy a relationship of 15° C.≤(P1−TgA)≤50° C., still more preferably satisfy a relationship of 15° C.≤(P1−TgA)≤40° C. When the (P1−TgA) is 15° C. or more and 70° C. or less, the bleeding property of the wax component to the surface of the toner at the time of the heating and pressurization of the toner is optimized, and hence the anti-winding property improves. Further, the adhesive force to paper increases and hence the low-temperature fixability improves. In addition, an adverse effect on the durability of the toner can be suppressed.

The P1, the TgA, and the (P1−TgA) can satisfy the ranges by regulating, for example, the glass transition temperature of the binder resin of the toner or the peak temperature of the maximum endothermic peak of the wax component.

The following embodiment is also preferred in the toner of the present invention. The toner particles each contain a polar resin. Further, the glass transition temperature (TgB) of the polar resin measured with a differential scanning calorimeter (DSC) is preferably 80° C. or more and 120° C. or less, more preferably 80° C. or more and 105° C. or less. Setting the TgB within the range can achieve an additionally high level of compatibility between the durability and low-temperature fixability of the toner. When the TgB in the toner of the present invention is 80° C. or more, such a tendency that a reduction in durability of the toner can be suppressed is observed, and when the TgB is 120° C. or less, such a tendency that a reduction in low-temperature fixability thereof can be suppressed is observed.

When the toner particles to be used in the present invention are produced by a suspension polymerization method, the polar resin is preferably added at the time of a polymerization reaction commencing on a dispersing step and ending on a polymerizing step. In that case, the state of existence of the polar resin can be controlled according to a balance between polarity shown by a polymerizable monomer composition to serve as the toner particles and that shown by an aqueous dispersion medium. That is, a thin-layer shell of the polar resin can be formed on the surface of a toner particle, or the polar resin can be caused to exist with gradient property from the surface of the toner particle toward its center. In addition, the addition of the polar resin enables freely control of the strength of the shell portion of the core-shell structure. Accordingly, the durability and fixability of the toner can be optimized.

The addition amount of the polar resin is preferably 1 part by mass or more and 30 parts by mass or less, more preferably 15 parts by mass or more and 30 parts by mass or less with respect to 100 parts by mass of the binder resin. When the addition amount is less than 1 part by mass, the state of existence of the polar resin in a toner particle is liable to be nonuniform, and hence the triboelectric charge distribution of the toner is liable to be broad. On the other hand, when the addition amount exceeds 30 parts by mass, a thin layer of the polar resin to be formed on the surface of the toner particle becomes thick and hence the fixability becomes liable to reduce.

Specific examples of the polar resin to be used in the present invention include a polyester resin, an epoxy resin, a styrene-acrylic acid copolymer, a styrene-methacrylic acid copolymer, and a styrene-maleic acid copolymer. In addition, the polar resin preferably has a carboxyl group. A styrene-methacrylic acid copolymer or styrene-acrylic acid copolymer having a peak molecular weight of 3,000 or more and 50,000 or less is particularly preferred as the polar resin because its addition amount at the time of the production of the toner can be freely controlled. In addition, the toner is preferably produced by suspension polymerization with a styrene-methacrylic acid copolymer or styrene-acrylic acid copolymer as the polar resin and a vinyl-based polymerizable monomer because in this case, the compatibility of the resin with the binder resin of the toner additionally improves. As a result, the polar resin easily exists with gradient property from the surface of a toner particle toward its center, adhesiveness between the core portion and the shell layer improves, and the durability of the toner improves.

As described above, the following characteristics are given as preferred characteristics which the toner of the present invention has: the core-shell structure is formed in a toner particle, the adhesiveness between the core portion and the shell layer is improved, the toner has large toughness against an external factor at the time of its pressurization at normal temperature, and the core component (especially the wax component) has bleeding property at the time of the heating of the toner. Those characteristics of the toner particles may contribute to the improvements of their development characteristic, transfer characteristic, fixation characteristic, and storage stability.

The toner of the present invention is characterized by satisfying relationships of $40 \leq Z(25) \leq 80$, $10 \leq Z(50) \leq 55$, and $15° C. \leq (P1-TgA) \leq 70° C.$ Of the conventional toners, a toner having a high value for the Z(25) has tended to show a small value for the P1−TgA. In order that a toner having additionally high low-temperature offset resistance may be obtained, the value for the P1−TgA needs to be increased by reducing the TgA. However, when the value for the TgA is reduced, it has been unable to obtain a good toner because the value for the Z(25) also reduces. As described above, it has been difficult to produce a toner having a high value for the Z(25) and a large value for the P1−TgA. In the present invention, the following conditions are given for producing a toner satisfying relationships of $40 \leq Z(25) \leq 80$ and $15° C. \leq (P1-TgA) \leq 70° C.$: a styrene-acrylic resin is used as a polar resin to be used in the shell layer of a toner particle, a polar resin having a low Tg is used, and the amount of the polar resin to be added is increased. A toner satisfying the conditions is excellent in low-temperature fixability and high-temperature offset resistance.

The binder resin to be incorporated into the toner of the present invention preferably contains 0.0050 to 0.025 mass % of divinylbenzene. The incorporation of divinylbenzene results in the crosslinking of the core portion, thereby leading to moderate bleeding of the wax component. Accordingly, a toner having high offset resistance is obtained.

Further, an additionally high effect is obtained when the toner of the present invention satisfies relationships of $30 \leq Z(50) \leq 50$ and $45 \leq Z(25) \leq 70$. That is, adopting such construction as described above can provide a toner having high durability and high blocking resistance while maintaining low-temperature fixability. In order that a toner having such properties as described above may be produced, it is effective to incorporate 0.015 to 0.025 mass % of divinylbenzene into the binder resin. As long as the content of divinylbenzene substantially falls within the range, the elasticity of the core portion can be improved while a low Tg of the core portion is maintained, whereby the effect becomes additionally significant. It should be noted that the content of divinylbenzene in the present invention is calculated as the amount of a unit derived from divinylbenzene.

The viscosity of the toner of the present invention measured by a flow tester heating method at a temperature of 100° C. (hereinafter, sometimes referred to as "melt viscosity") is preferably $0.3 \times 10^4$ Pa·s or more and $2.0 \times 10^4$ Pa·s or less, more preferably $0.3 \times 10^4$ Pa·s or more and $1.5 \times 10^4$ Pa·s or less. When the melt viscosity of the toner is $0.3 \times 10^4$ Pa·s or more and $2.0 \times 10^4$ Pa·s or less, its anti-winding property improves by virtue of moderate bleeding property of the wax component. Further, its adhesive force to paper increases and hence its low-temperature fixability improves.

The melt viscosity is set to a relatively low value. In the toner of the present invention, the values for the R(25) and the Z(25) satisfy the ranges, the core-shell structure is formed, and the adhesiveness between the core portion and the shell layer is high. Accordingly, a reduction in durability of the toner or reduction in storage stability thereof which may generally occur owing to a low melt viscosity hardly occurs.

The melt viscosity can satisfy the range by regulating, for example, the glass transition temperature or weight average molecular weight of the polar resin or of the binder resin, or the kind of the wax component.

(Microcompression Test)

Next, a microcompression test method for toner to be employed in the present invention is described with reference to FIG. 2.

Figure 2:
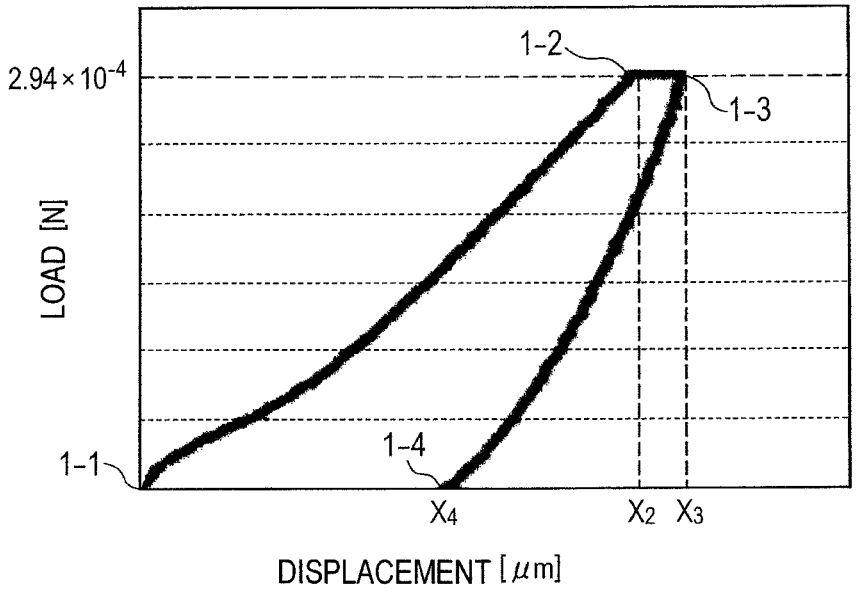
FIG. 2 illustrates a load-displacement curve in a microcompression test on toner.

FIG. 2 illustrates a profile upon measurement of the toner of the present invention by the microcompression test (load-displacement curve obtained by plotting a load on the toner and its displacement amount). In the figure, the axis of abscissa indicates the displacement amount in which the toner deforms, and the axis of ordinate indicates the amount of the load applied to the toner.

The microcompression test in the present invention was performed by using an ultra-microhardness meter ENT1100 (manufactured by ELIONIX CO., LTD). A flat indenter having an apical surface of 20 μm×20 μm was used as an indenter.

The point 1-1 in the figure corresponds to the initial state (origin) before the initiation of the test, and the load is applied at a loading rate of $9.8\times10^{-5}$ N/sec so as to reach a maximum load of $2.94\times10^{-4}$ N. The point 1-2 corresponds to a state immediately after the load has reached the maximum load. If a measuring temperature is set to 25° C., the displacement amount in the state is defined as $X_{2(25)}$ (μm). The toner is left to stand under the load in the state represented by the point 1-2 for 0.1 second. A state immediately after the completion of the standing is represented by the point 1-3 and the maximum displacement amount in the state is defined as $X_{3(25)}$ (μm). Further, the time point at which, after having reached the maximum load, the load is reduced at an unloading rate of $9.8\times10^{-5}$ N/sec and then the load becomes 0 N corresponds to a state represented by the point 1-4. The displacement amount in the state is defined as $X_{4(25)}$ (μm).

[The gradient of the load-displacement curve] R(25) from the origin to the point at which the load reached the maximum load was obtained by approximating the load-displacement curve from the point 1-1 to the point 1-2 to a primary straight line and calculating the gradient of the straight line as [$2.94\times10^{-4}$/displacement amount $X_{2(25)}$] (N/μm). In addition, the Z(25) representing a percentage of the elastic deformation amount ($X_{2(25)}-X_{4(25)}$) to the maximum displacement amount $X_{3(25)}$ (hereinafter, sometimes referred to as "recovery ratio (%)") was determined as $\{(X_{3(25)}-X_{4(25)})/X_{3(25)}\}\times100$. Further, the value for the Z (50) is a value determined from the maximum displacement amount $X_{3(50)}$ and the displacement amount $X_{4(50)}$ obtained by the same method as the method of measuring the Z(25) except that the measurement is performed at a measuring temperature of 50° C. in the microcompression test on the toner.

Actual measurement is performed as described below. The toner is applied onto a ceramic cell and then air is blown on the resultant so that the toner may be dispersed on the ceramic cell. After that, the ceramic cell is set in the ultra-microhardness meter. In addition, at the time of the measurement, the ceramic cell was brought into such a state that its temperature could be controlled, and the temperature of the ceramic cell was defined as a measuring temperature. That is, the R(25) and the Z(25) were measured by adjusting the temperature of the cell to 25° C., and the Z(50) was measured by adjusting the temperature of the cell to 50° C. It should be noted that the temperature of the ceramic cell was adjusted as described below. The ceramic cell was set in the ultra-microhardness meter, and once the temperature of the ceramic cell reached the measuring temperature, the ceramic cell was left to stand for 10 minutes or more, followed by the initiation of the measurement.

The measurement was performed by selecting the toner present as one particle in a screen for measurement (measuring 160 μm long by 120 μm wide) while looking through a microscope included with the ultra-microhardness meter. A particle having a particle diameter of a number average particle diameter D1±0.2 μm was selected as the toner in order for a displacement amount error to be eliminated to the extent possible. Used as the particle diameter of the toner was a value for an aspect ratio [(longer diameter+shorter diameter)/2] determined from the longer diameter and shorter diameter of a toner particle measured with software included with the ultra-microhardness meter ENT1100 on the screen for measurement.

With regard to measurement data, 100 arbitrary particles were selected and subjected to the measurement, and then the Z(25), the Z(50), and the R(25) were each determined as the arithmetic average of eighty pieces of data obtained by removing ten largest values and ten smallest values from the resultant one hundred pieces of data on the corresponding one of the Z(25), the Z(50), and the R(25).

(Differential Scanning Calorimetry)

The TgA, the TgB, and the P1 were measured with a differential scanning calorimeter (DSC measuring apparatus) Q1000 (manufactured by TA Instruments Japan Inc.) in conformity with ASTM D3418-82 by the following method under the following conditions.

(Measurement Conditions and Method)

(1) A modulated mode is used.

(2) Equilibrium is kept at a temperature of 20° C. for 5 minutes.

(3) The temperature is increased to 140° C. at 1° C./min by using a modulation of 1.0° C./min.

(4) Equilibrium is kept at a temperature of 140° C. for 5 minutes.

(5) The temperature is decreased to 20° C.

About 3 mg of a measurement sample are precisely weighed. The sample is loaded into a pan made of aluminum, an empty aluminum pan is used for comparison, and the measurement is performed in the measuring range of 20 to 140° C. at a rate of temperature increase of 1° C./min.

Here, the glass transition temperature (Tg) is determined by a middle point method. In addition, the peak temperature (P1) of the maximum endothermic peak of the toner is the temperature at which the endothermic peak shows a local maximum. When multiple endothermic peaks exist, an endothermic peak having the highest peak from a baseline in a region above the endothermic peaks is defined as the maximum endothermic peak.

(Measurement of Number Average Particle Diameter)

In addition, a method of measuring the number average particle diameter (D1) of the toner is as described below.

The measurement was performed with a Coulter Multisizer (manufactured by Beckman Coulter, Inc.), to which an interface for outputting a number distribution and a volume distribution (manufactured by Nikkaki Bios Co., Ltd.), and a PC9801 personal computer (manufactured by NEC) had been connected, according to the operation manual of the apparatus.

Specifically, a 1% aqueous solution of NaCl was prepared as an electrolytic solution with first class grade sodium chloride. For example, an ISOTON R-II (manufactured by Coulter Scientific Japan) can be used. 20 Milligrams of a measurement sample (toner) were added to 150 ml of the electrolytic solution. The electrolytic solution in which the sample had been suspended was subjected to a dispersion treatment for 3 minutes with an ultrasonic dispersing unit, and then the number average particle diameter (D1) was determined by measuring the volume and number of toner particles each having a particle diameter of 2.0 μm or more with the Coulter Multisizer and a 100-μm aperture.

(Measurement of Viscosity by Flow Tester Heating Method)

The melt viscosity of the toner was measured by the following method.

As described above, the melt viscosity of the toner in the present invention is the viscosity of the toner measured by a flow tester heating method at a temperature of 100° C. The measurement was performed with a flow tester CFT-500D (manufactured by Shimadzu Corporation) according to the operation manual of the apparatus under the following conditions.

Sample: About 1.1 g of toner is weighed and molded with a pressure molding machine to prepare a sample.
Die hole diameter: 0.5 mm
Die length: 1.0 mm
Cylinder pressure: $9.807\times10^5$ (Pa)
Measurement mode: Heating method
Rate of temperature increase: 4.0° C./min The viscosities (Pa·s) of the toner at temperatures of 50° C. to 200° C. were measured by the method described above, and the viscosity (Pa·s) at a temperature of 100° C. was determined.

Examples of the wax component to be used in the present invention include the following.

Petroleum-based waxes and derivatives thereof such as paraffin wax, microcrystalline wax, and petrolatum; montan wax and derivatives thereof; hydrocarbon wax and derivative thereof by a Fischer-Tropsch method; polyolefin wax and derivatives thereof such as polyethylene wax and polypropylene wax; natural wax and derivatives thereof such as carnauba wax and candelilla wax; higher aliphatic alcohols; fatty acids such as stearic acid and palmitic acid; acid amide wax; ester wax; cured castor oil and derivatives thereof; plant-based wax; and animal wax.

As the derivatives, oxides, a block copolymer with a vinyl-based monomer, and graft modified products are exemplified.

Of those, the ester wax and the hydrocarbon wax are particularly preferred from such a viewpoint that the waxes are excellent in releasability. Further, the hydrocarbon wax is more preferably used in order that the control of the core-shell structure in the toner of the present invention and the expression of an effect of the present invention may be facilitated.

The content of the wax component is preferably 4 parts by mass or more and 25 parts by mass or less with respect to 100 parts by mass of the binder resin. Setting the content of the wax component within the range imparts moderate bleeding property of the wax component at the time of the heating and pressurization of the toner, thereby improving the anti-winding property. Further, the exposure of the wax component to the surface of the toner due to a stress which the toner receives at the time of development or transfer is suppressed, and hence each toner particle can obtain uniform triboelectric chargeability.

In the present invention, polymers each having a sulfonic group, a sulfonate group, or a sulfonic acid ester group at a side chain thereof are preferably used in the toner particles mainly for the purposes of charge control and the stabilization of granulation in the aqueous dispersion medium. Of those, a polymer or copolymer having a sulfonic group, a sulfonate group, or a sulfonic acid ester group is particularly preferably used. The addition amount of such polymer as described above is preferably 0.1 part by mass or more and 3 parts by mass or less with respect to 100 parts by mass of the binder resin.

When the toner of the present invention is produced by the suspension polymerization method, the addition of the polymer or copolymer having a sulfonic group, a sulfonate group, or a sulfonic acid ester group promotes not only the stabilization of the granulation but also the core-shell structure of a toner particle at a polymerization stage. Accordingly, an additionally high level of compatibility between the durability and fixability of the toner can be achieved.

A monomer having a sulfonic group, a sulfonate group, or a sulfonic acid ester group for the production of the polymer or the copolymer is, for example, styrenesulfonic acid, 2-acrylamide-2-methylpropanesulfonic acid, 2-methacrylamide-2-methylpropanesulfonic acid, vinylsulfonic acid, methacrylic sulfonic acid, or an alkyl ester thereof.

The polymer or copolymer containing a sulfonic group, a sulfonate group, or a sulfonic acid ester group to be used in the present invention may be a homopolymer of the above-mentioned monomer, or may be a copolymer of the above-mentioned monomer and any other monomer. The monomer for forming the copolymer with the above-mentioned monomer is, for example, a vinyl-based polymerizable monomer, and a monofunctional polymerizable monomer or a polyfunctional polymerizable monomer can be used.

The binder resin to be used in the present invention is, for example, a styrene-acrylic copolymer, a styrene-methacrylic copolymer, an epoxy resin, or a styrene-butadiene copolymer. A polymerizable monomer to be used in the production of the binder resin is, for example, a vinyl-based polymerizable monomer capable of radical polymerization. A monofunctional polymerizable monomer or a polyfunctional polymerizable monomer can be used as the vinyl-based polymerizable monomer.

Examples of the above-mentioned vinyl-based polymerizable monomer include the following.

Styrene; styrene-based monomers such as o- (m-, p-)methylstyrene and m- (p-)ethylstyrene; acrylate-based monomers or methacrylate-based monomers such as methyl acrylate, methyl methacrylate, ethyl acrylate, ethyl methacrylate, propyl acrylate, propyl methacrylate, butyl acrylate, butyl methacrylate, octyl acrylate, octyl methacrylate, dodecyl acrylate, dodecyl methacrylate, stearyl acrylate, stearyl methacrylate, behenyl acrylate, behenyl methacrylate, 2-ethylhexyl acrylate, 2-ethylhexyl methacrylate, dimethyl aminoethyl acrylate, dimethyl aminoethyl methacrylate, diethyl aminoethyl acrylate, and diethylaminoethyl methacrylate; and ene-based monomers such as butadiene, isoprene, cyclohexene, acrylonitrile, methacrylonitrile, acrylamide, and methacrylamide.

Each of those polymerizable monomers is used alone, or, in general, two or more of them are appropriately mixed before use with reference to a theoretical glass transition temperature (Tg) described in a publication "Polymer Handbook", second edition, III-p 139 to 192 (published by John Wiley & Sons).

In addition, when the toner of the present invention is produced, a low-molecular-weight polymer can be added so that the toner of the present invention may show a preferred molecular weight distribution. When the toner is produced by a pulverization method, the low-molecular-weight polymer can be added during melting and kneading with the binder resin or the like, and further, when the toner is produced by the suspension polymerization method, the low-molecular-weight polymer can be added to the polymerizable monomer composition. The low-molecular-weight polymer preferably has a weight average molecular weight (Mw) measured by gel permeation chromatography (GPC) in the range of 2,000 or more to 5,000 or less, and has a ratio Mw/Mn of less than 4.5, preferably less than 3.0.

Examples of the low-molecular-weight polymer include a low-molecular-weight polystyrene, a low-molecular-weight styrene-acrylate copolymer, and a low-molecular-weight styrene-acrylic copolymer.

In the present invention, a crosslinking agent may be used at the time of the synthesis of the binder resin for controlling the molecular weight of the binder resin of the toner while improving the mechanical strength of each toner particle.

As described above, the crosslinking agent to be used in the present invention is preferably divinylbenzene, but such crosslinking agent as described below can also be used.

Examples of a bifunctonal crosslinking agent include bis (4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycol #200, #400, and #600, dipropylene glycol diacrylate, polypropylene glycol diacrylate, polyester-type diacrylate (MANDA, Nippon Kayaku Co., Ltd.), and those obtained by changing the above-mentioned diacylates to dimethacrylates.

Examples of a polyfunctional crosslinking agent include pentaerythritol triacrylate, trimethylolethane triacrylate, trimethylolpropane triacrylate, tetramethylolmethane tetraacrylate, oligoester acrylate and methacrylate thereof, 2,2-bis(4-mathacryloxypolyethoxyphenyl)propane, diallylphthalate, triallylcyanurate, triallylisocyanurate, and triallyltrimellitate.

The addition amount of any such crosslinking agent is preferably 0.0050 part by mass or more and 0.050 part by mass or less, more preferably 0.0050 part by mass or more and 0.025 part by mass or less with respect to 100 parts by mass of the polymerizable monomer.

Examples of the polymerization initiator to be used in the present invention include: azo-based or diazo-based polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile; and peroxide-based polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, and tert-butyl-peroxypivalate.

The usage of any such polymerization initiator is generally 3 parts by mass or more and 20 parts by mass or less with respect to 100 parts by mass of the polymerizable monomer, though the usage varies depending on a target degree of polymerization. The kind of polymerization initiators slightly varies depending on a polymerization method. One kind of the polymerization initiators is used alone, or two or more kinds of them are used as a mixture with reference to a 10-hour half-life temperature.

A colorant that is preferably used in the present invention is, for example, any one of the following organic pigments or dyes, and inorganic pigments.

As the organic pigments or organic dyes as a cyan colorant, a copper phthalocyanine compound or derivatives thereof, an anthraquinone compound, and a basic dye lake compound can be used.

Specifically, exemplified are C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62, and C.I. Pigment Blue 66.

Examples of the organic pigments or organic dyes as a magenta colorant include a condensed azo compound, a diketopyrrolopyrrole compound, anthraquinone, a quinacridone compound, a base dyed lake compound, a naphthol compound, a benzimidazolone compound, a thioindigo compound, and a perylene compound.

Specifically, exemplified are C.I. Pigment Red 2, C.I. Pigment Red 3, C.I. Pigment Red 5, C.I. Pigment Red 6, C.I. Pigment Red 7, C. I. Pigment Violet 19, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 150, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221, and C.I. Pigment Red 254.

As the organic pigments or organic dyes as a yellow colorant, compounds typified by a condensed azo compound, an isoindolinone compound, an anthraquinone compound, an azo metal complex, a methine compound, and an arylamide compound are used.

Specifically, exemplified are C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 97, C.I. Pigment Yellow 109, C.I. Pigment Yellow 110, C.I. Pigment Yellow 111, C.I. Pigment Yellow 120, C.I. Pigment Yellow 127, C.I. Pigment Yellow 128, C.I. Pigment Yellow 129, C.I. Pigment Yellow 147, C.I. Pigment Yellow 151, C.I. Pigment Yellow 154, C.I. Pigment Yellow 155, C.I. Pigment Yellow 168, C.I. Pigment Yellow 174, C.I. Pigment Yellow 175, C.I. Pigment Yellow 176, C.I. Pigment Yellow 180, C.I. Pigment Yellow 181, C.I. Pigment Yellow 191, and C.I. Pigment Yellow 194.

As a black colorant, carbon black and one toned to black by using the above-mentioned yellow/magenta/cyan colorants can be used.

The colorants may be used alone or as mixtures. Further, the colorants may be used in a solid solution state. The colorants used in the toner of the present invention are selected in terms of hue angle, chroma saturation, brightness, light resistance, OHP transmissivity, and dispersibility in toner.

The addition amount of the colorants is preferably 1 part by mass or more and 20 parts by mass or less with respect to 100 parts by mass of the binder resin.

In the toner of the preset invention, a charge control agent can be mixed with the toner particles before use as required. Blending the charge control agent can stabilize the charge characteristic of the toner, and control the triboelectric charge quantity of the toner to an optimum one in accordance with a developing system.

A known agent can be utilized as the charge control agent, and a charge control agent having the following characteristics is particularly preferred: the agent can be triboelectrically charged at a high speed, and can stably maintain a certain triboelectric charge quantity. Further, when the toner is directly produced by a polymerization method, a charge control agent having the following characteristics is particularly preferred: the agent has low polymerization-inhibiting property, and is substantially free of any soluble matter in the aqueous dispersion medium.

Examples of the above-mentioned charge control agent that can control the toner so as to have a negative charge include organic metal compounds and chelate compounds. Also there are exemplified monoazometal compounds, acetylacetone metal compounds, aromatic oxycarboxylic acids, aromatic dicarboxylic acids, and metal compounds of oxycarboxylic acids and dicarboxylic acids. Other examples include aromatic oxycarboxylic acids, aromatic mono- and polycarboxylic acid anhydrides and esters thereof as well as phenol derivatives such as bisphenols. Further examples include urea derivatives, metal-containing naphthoic acid-based compounds, boron compounds, quaternary ammonium salts, calixarene, and a resin-based charge control agent.

On the other hand, examples of the charge control agent that can control the toner so as to have a positive charge include: nigrosine and nigrosine-modified products with fatty acid metal salts; guanidine compounds; imidazole compounds; tributylbenzylammonium-1-hydroxy-4-naphthosulfonic acid salts, quaternary ammonium salts such as tetrabutylammonium tetrafluoroborate, and analogues thereof including onium salts such as phosphonium salts and lake pigments thereof; triphenylmethane dyes and lake pigments thereof (laking agents include phosphotungstic acid, phosphomolybdic acid, phosphotungstomolybdic acid, tannic acid, lauric acid, gallic acid, ferricyanide, and ferrocyanide); metal salts of higher fatty acids; and a resin-based charge control agent.

In the toner of the present invention, one kind of those charge control agents may be incorporated alone, or two or more kinds of them may be incorporated in combination.

Of those charge control agents, a metal-containing salicylic acid-based compound is preferred, and the metal is particularly preferably aluminum or zirconium. An aluminum compound of 3,5-di-tert-butylsalicylic acid is the most preferred charge control agent.

The charge control agent is blended in an amount of preferably 0.01 part by mass or more and 20 parts by mass or less, more preferably 0.5 part by mass or more and 10 parts by mass or less with respect to 100 parts by mass of the binder resin. However, the addition of the charge control agent is not indispensable to the toner of the present invention, and active utilization of the triboelectric charging of the toner with a toner layer thickness-regulating member or toner carrying member can eliminate the need for the incorporation of the charge control agent into the toner.

The inorganic fine powder is externally added to the toner of the present invention for the purpose of improving its flowability.

The inorganic fine powder to be externally added to each of the toner particles of the present invention preferably contains at least a silica fine powder. The number average primary particle diameter of the silica fine powder is preferably 4 nm or more and 80 nm or less. When the number average primary particle diameter in the present invention falls within the range, the flowability of the toner improves and the storage stability of the toner also improves.

The number average primary particle diameter of the inorganic fine powder is measured as described below.

The number average primary particle diameter is obtained by observing the inorganic fine powder with a scanning electron microscope, measuring the particle diameters of 100 particles of the inorganic fine powder in the field of view, and determining their average particle diameter.

Further, as the inorganic fine powder, a silica fine powder and a titanium oxide, alumina, and a multiple oxide fine powder of them can be used in combination. As the inorganic fine powder used in combination, the titanium oxide is preferred.

Examples of the above-mentioned silica fine powder include fine powders of both dry silica referred to as fumed silica or dry silica produced through the vapor phase oxidation of a silicon halide and wet silica produced from water glass. The dry silica having a small amount of silanol groups present on its surface and inside the silica, and containing a small amount of production residue of $Na_2O$ and $SO_3^{2-}$ is preferred as silica. In addition, the dry silica can also be a composite fine powder of silica and any other metal oxide obtained by using other metal halide such as aluminum chloride or titanium chloride and a silicon halide in combination in a production step. The composite fine powder is also included in silica.

The inorganic fine powder is added for improving the flowability of the toner and uniformizing the triboelectric charge of the toner particles. The inorganic fine powder is preferably subjected to a hydrophobic treatment before use because functions of the adjustment of the triboelectric charge quantity of the toner, an improvement in environmental stability of the toner, and improvements in characteristics of the toner under a high-humidity environment can be imparted by subjecting the inorganic fine powder to a hydrophobic treatment. When the inorganic fine powder externally added to the toner particles absorbs moisture, the triboelectric charge quantity of the toner reduces, and a reduction in developability or transferability is apt to occur.

Examples of a treatment agent for hydrophobizing the inorganic fine powder include: unmodified silicone varnish, various kinds of modified silicone varnish, unmodified silicone oil, various kinds of modified silicone oil, a silane compound, a silane coupling agent, an organic silicone compound, and an organic titanium compound. Those treatment agents may be used alone or in combination.

Of those, an inorganic fine powder treated with silicone oil is preferred. A hydrophobic-treated inorganic fine powder obtained by treating an inorganic fine powder with silicone oil simultaneously with or after a hydrophobic treatment with a coupling agent is more preferred because the use of such fine powder can maintain the triboelectric charge quantity of the toner particles at a high level even under a high-humidity environment, and can reduce selective developability.

In the present invention, when the toner is obtained by employing a polymerization method, attention must be paid to the polymerization-inhibiting property and aqueous phase-migrating property of the colorant. Thus, the colorant is preferably subjected to a surface modification such as a hydrophobic treatment with a substance that does not inhibit polymerization. Particular attention must be paid upon use of any one of the dye-based colorants and carbon black because many of them each have polymerization-inhibiting property.

A method of suppressing polymerization-inhibiting property of a dye-based colorant is, for example, a method involving polymerizing the polymerizable monomer in the presence of the dye in advance, and the resultant colored polymer is added to the polymerizable monomer composition.

In addition, carbon black may be treated with a substance that reacts with a surface functional group of carbon black such as polyorganosiloxane as well as a treatment similar to that in the case of any one of the above-mentioned dyes.

The toner particles used in the present invention, which may be produced by employing any approach, are preferably produced by a production method involving granulation in an aqueous dispersion medium such as a suspension polymerization method, an emulsion polymerization method, or a suspension granulation method. The toner particles are particularly preferably toner particles obtained by dispersing, in an aqueous dispersion medium, a polymerizable monomer composition containing at least a polymerizable monomer to be used in production of the binder resin, a coloring agent, and a wax component, granulating the resultant, and polymerizing the polymerizable monomer.

Hereinafter, the method of producing the toner will be described by taking the suspension polymerization method suitable in obtaining the toner particles used in the present invention as an example.

First, the polymerizable monomer to be used in production of the binder resin, the colorant, the wax component, and, as required, any other additive are uniformly dissolved or dispersed with a dispersing machine such as a homogenizer, a ball mill, a colloid mill, or an ultrasonic dispersing machine, and a polymerization initiator is dissolved in the resultant so that a polymerizable monomer composition may be prepared. Next, polymerization is performed by suspending the polymerizable monomer composition in an aqueous dispersion medium containing a dispersant, whereby the toner particles are produced. The above-mentioned polymerization initiator may be added simultaneously with the addition of the other additive to a polymerizable monomer, or may be mixed immediately before the suspension in the aqueous dispersion medium. Alternatively, the polymerization initiator or the polymerization initiator dissolved in a solvent can be added immediately after granulation and before the initiation of the polymerization reaction.

Any one of the known inorganic and organic dispersants can be used as the above-mentioned dispersant.

Specifically, examples of the inorganic dispersant include tricalcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica, and alumina.

On the other hand, as the organic dispersant, polyvinyl alcohol, gelatin, methyl cellulose, methyl hydroxypropyl cellulose, ethyl cellulose, sodium salt of carboxymethyl cellulose, and starch are exemplified.

In addition, as the dispersant, commercially available non-ion-, anion-, and cation-type surfactant can be used. Examples of the surfactant include sodium dodecyl sulfate, sodium tetradecyl sulfate, sodium pentadecyl sulfate, sodium octyl sulfate, sodium oleate, sodium laurate, potassium stearate, and calcium oleate.

The above-mentioned dispersant is preferably an inorganic, hardly-water-soluble dispersant, more preferably an acid-soluble, hardly-water-soluble, inorganic dispersant.

In addition, in the present invention, when the aqueous dispersion medium is prepared by using a hardly-water-soluble, inorganic dispersant, the dispersant is preferably used in an amount of 0.2 part by mass or more and 2.0 parts by mass or less with respect to 100 parts by mass of the polymerizable monomer. In addition, in the present invention, the aqueous dispersion medium is preferably prepared by using 300 parts by mass or more and 3,000 parts by mass or less of water with respect to 100 parts by mass of the polymerizable monomer composition.

In the present invention, when an aqueous dispersion medium in which such hardly-water-soluble, inorganic dispersant as described above is dispersed is prepared, a commercially available dispersant may be dispersed as it is. Alternatively, the aqueous dispersion medium may be prepared by producing a hardly-water-soluble, inorganic dispersant in a liquid medium such as water under high-speed stirring in order that dispersant particles having fine, uniform particle sizes may be obtained. For example, when tricalcium phosphate is used as a dispersant, the fine particles of tricalcium phosphate are formed by mixing an aqueous solution of sodium phosphate and an aqueous solution of calcium chloride under high-speed stirring.

<Developing Roller>

Figure 3A:
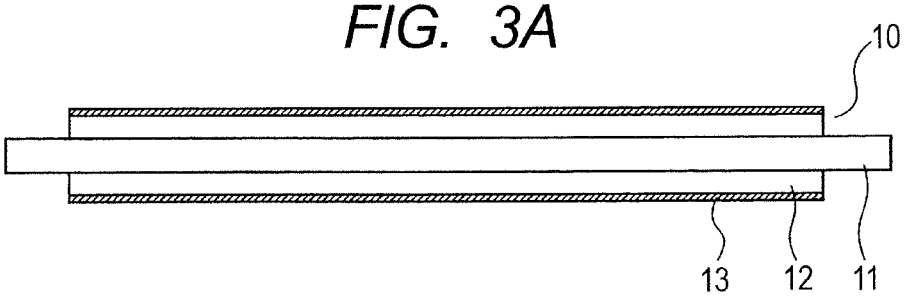
FIG. 3A is a schematic view illustrating an example of a developing roller of the present invention, the figure being a schematic sectional view parallel to a longitudinal direction.
Figure 3B:
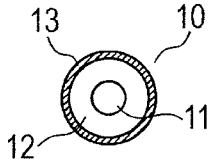
FIG. 3B is a schematic view illustrating an example of the developing roller of the present invention, the figure being a schematic sectional view perpendicular to the longitudinal direction.

As illustrated in FIG. 3A and FIG. 3B, a developing roller 10 of the present invention is constituted of an electro-conductive member obtained by fixing an elastic layer 12 to the outer peripheral surface of a columnar or hollow cylindrical electro-conductive mandrel 11 and laminating a surface layer 13 on the outer peripheral surface of the elastic layer 12.

The electro-conductive mandrel 11 functions as an electrode and supporting member for the developing roller 10, and is constituted of an electro-conductive material such as: a metal or alloy like aluminum, a copper alloy, or stainless steel; iron subjected to a plating treatment with chromium or nickel; or a synthetic resin having electro-conductivity.

The elastic layer 12 formed on the periphery of the mandrel imparts, to the developing roller, such hardness or elasticity that the developing roller is pressed against a photosensitive member with a proper nip width and a proper nip pressure so that the toner can be supplied in a proper amount to an electrostatic latent image formed on the surface of the photosensitive member. In ordinary cases, the elastic layer 12 is preferably formed of a molded body of a rubber material. A silicone rubber is preferred as the rubber material because the rubber is excellent in deformation recoverability and flexibility, and a cured substance of an addition-curing-type dimethyl silicone rubber is particularly suitably used.

In addition, in order that the durability may be improved by strengthening bonding between the surface layer and the elastic layer, the abundance of a water molecule near the bonding interface is desirably as small as possible. The silicone rubber can reduce the coefficient of water absorption of the elastic layer to an extremely low level because the rubber component itself has low polarity and low moisture-absorbing property. Accordingly, a bonding effect based on a hydrophobic interaction with the polyurethane to be incorporated into the surface layer can be expressed. That is why the silicone rubber is preferred. Specifically, the elastic layer 12 more preferably has a coefficient of water absorption based on a JIS K7209 A method of 0.10 mass % or less.

The addition-curing-type dimethyl silicone rubber to be used in the elastic layer 12 is preferably a polydimethylsiloxane. In addition to that, for example, a polymethylvinylsiloxane, a polyphenylvinylsiloxane, a polymethoxymethylsiloxane, a polyethoxymethylsiloxane, or a copolymer of these polysiloxanes may be incorporated.

Electro-conductive fine particles are incorporated into the elastic layer 12. Fine particles of carbon black, an electro-conductive metal such as aluminum or copper, or an electro-conductive metal oxide such as zinc oxide, tin oxide, or titanium oxide can be used as the electro-conductive fine particles. Carbon black is particularly preferred because satisfactory electro-conductivity can be obtained at a relatively small addition amount.

Of such electro-conductive fine particles as described above, fine particles each having a low affinity for water are particularly preferably used in order that the coefficient of water absorption of the elastic layer 12 may be reduced. In the case of, for example, the carbon black, carbon black which has a relatively large primary particle diameter and whose surface is not subjected to a polarizing treatment is preferred. Specifically, the primary particle diameter preferably falls within the range of 30 nm or more to 60 nm or less in consideration of rubber-reinforcing property and electro-conductivity. With regard to the surface characteristic of the carbon black, carbon black which is neutral or subjected to a hydrophobic treatment is suitable, and carbon black having a pH of 5.0 or more and 8.0 or less is preferred.

When such carbon black as described in the foregoing is used as the electro-conductive fine particles, a preferred blending amount of the carbon black is about 5 to 20 parts by mass with respect to 100 parts by mass of the rubber in the rubber material.

When electro-conductive fine particles except the carbon black are used, their addition amount are preferably adjusted according to the moisture-absorbing properties of the fine particles as appropriate so that the coefficient of water absorption of the elastic layer may be 0.10 mass % or less.

In addition to the electro-conductive fine particles, various additives such as a non-electro-conductive filler, a crosslinking agent, and a catalyst are appropriately blended into the elastic layer 12. Examples of the non-electro-conductive filler include silica, quartz powder, titanium oxide, and zinc oxide. The kind and addition amount of the non-electro-conductive filler are preferably appropriately adjusted without causing an increase in coefficient of water absorption, like those of the electro-conductive fine particles.

Examples of the crosslinking agent include di-t-butyl peroxide, 2,5-dimethyl-2,5-di(t-butylperoxy)hexane, and dicumyl peroxide.

The thickness of the elastic layer 12 is preferably from 2.0 to 6.0 mm, particularly preferably from 3.0 to 5.0 mm.

The urethane resin to be incorporated into the surface layer 13 in the present invention has, between two adjacent urethane bonds, a structure represented by the following structural formula (a), and one or both of structures selected from a structure represented by the following structural formula (b) and a structure represented by the following structural formula (c).

That is, the urethane resin according to the present invention has, in a molecule thereof, such a structure that the structure represented by the following structural formula (a), and at least one or both of the structures selected from the group consisting of the structure represented by the following structural formula (b) and the structure represented by the following structural formula (c) are sandwiched between the two urethane bonds.

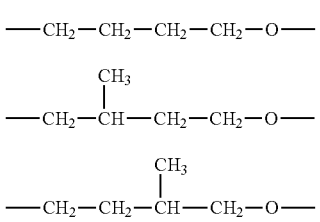

Structural formula (a)

Structural formula (b)

Structural formula (c)

Figure 6:
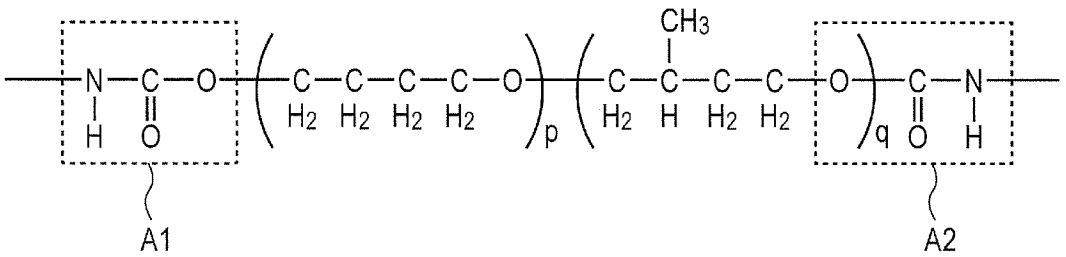
FIG. 6 is a view illustrating a characteristic structure which a urethane resin according to the present invention has.
Figure 7:
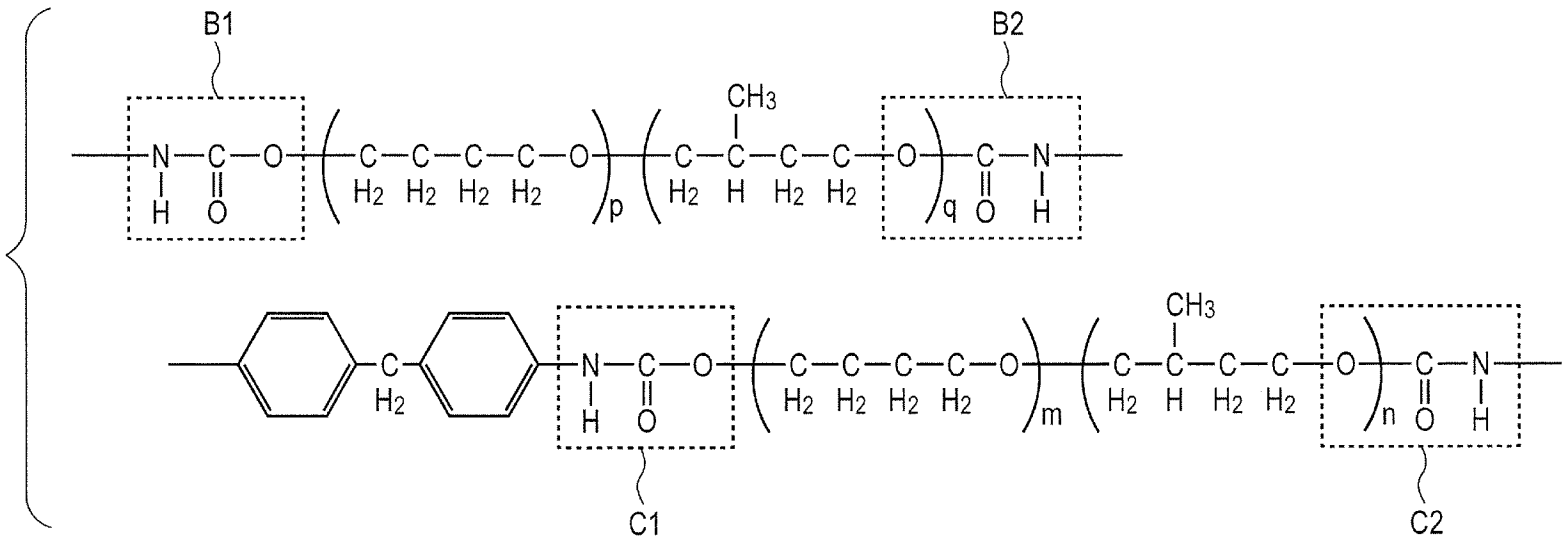
FIG. 7 is a view illustrating a characteristic structure which the urethane resin according to the present invention has.

FIG. 6 and FIG. 7 each illustrate part of a characteristic structure which the urethane resin according to the present invention has. In FIG. 6, the structure represented by the structural formula (a) and the structure represented by the structural formula (b) are sandwiched between adjacent urethane bonds A1 and A2.

In addition, in the urethane resin according to FIG. 7, the structure represented by the structural formula (a) and the structure represented by the structural formula (b) are sandwiched between adjacent urethane bonds B1 and B2, and are sandwiched between adjacent urethane bonds C1 and C2.

Such polyurethane is extremely excellent in flexibility by virtue of the presence of a polyether component represented by the structural formula (a). In addition, the polyurethane has extremely low crystallinity in a low-temperature region because the polyurethane has, in a molecule thereof, one or both of the structures selected from the group consisting of the structure represented by the structural formula (b) and the structure represented by the structural formula (c). Accordingly, the developing roller provided with the surface layer containing the polyurethane according to the present invention is flexible even under an environment having a temperature as low as 5° C. and its hardness hardly increases. As a result, the application of the developing roller to the formation of an electrophotographic image alleviates a stress applied by the developing roller to the toner even under the low-temperature environment, and effectively suppresses the occurrence of the filming of the toner to the surface of the developing roller.

Further, the polyurethane according to the present invention has, in a molecule thereof, the structure represented by the structural formula (b) or (c) having higher hydrophobicity than that of the structure represented by the structural formula (a). Accordingly, the affinity of the urethane resin itself for water reduces and hence the polyurethane can be made relatively low water-absorbing for a urethane resin. Further, in a high-temperature region, the presence of a methyl group as a side chain in the structure represented by the structural formula (b) or (c) suppresses the molecular mobility of the polyurethane in the high-temperature region. Accordingly, the tackiness of the surface of the developing roller according to the present invention is hardly raised even under a high-temperature, high-humidity environment, and hence the sticking of the toner to the surface of the developing roller under the high-temperature, high-humidity environment can be effectively suppressed.

The urethane resin according to the present invention is preferably obtained by randomly copolymerizing the structure represented by the structural formula (a), and at least one selected from the group consisting of the structures represented by the structural formula (b) and the structural formula (c). This is because the reducing effect on the crystallinity in the low-temperature region and the suppressing effect on the molecular mobility in the high-temperature region become additionally high.

In the polyurethane, a ratio "the molar ratio of the structure of the structural formula (a) ":" the molar ratio of at least one structure selected from the structural formulae (b) and (c)" is preferably 80:20 or more and 50:50 or less. When the molar ratios of the structures of the respective chemical formulae fall within the range, additionally excellent suppressing effects are obtained in terms of both the sticking property of the toner to the surface and the peeling of the surface layer. In addition, the polyurethane is excellent in flexibility in the low-temperature region and hence its durability improves.

The polyurethane to be incorporated into the surface layer 13 is preferably obtained by thermally curing: the polyether diol having the structure of the structural formula (a), and at least one structure selected from the structural formulae (b) and (c), or a hydroxyl group-terminated prepolymer obtained by causing the polyether diol and an aromatic diisocyanate to react with each other; and an isocyanate group-terminated prepolymer obtained by causing the polyether diol and an aromatic isocyanate to react with each other.

As a synthesis method of polyurethane, generally the following kinds of methods are used.

A one-shot method involving mixing a polyol component and a polyisocyanate component and subjecting to a reaction A method involving subjecting an isocyanate group-terminated prepolymer obtained by subjecting part of a polyol component to a reaction with an isocyanate component to a reaction with a chain extender such as a low-molecular-weight diol or a low-molecular-weight triol However, the polyether diol having the structure of the structural formula (a), and at least one structure selected from the structural formulae (b) and (c) is a material having low polarity. Accordingly, the polyether diol has low compatibility with an isocyanate having high polarity, and hence a phase separation into a portion having a high polyol ratio and a portion having a high isocyanate ratio is liable to occur in the system on a microscopic scale. An unreacted component is liable to remain in the portion having a high polyol ratio and the bleeding of the remaining unreacted polyol serves as a cause for the sticking of the toner in some cases.

An isocyanate having high polarity needs to be used in an excessive amount for reducing the remaining of the unreacted polyol. As a result, the coefficient of water absorption of the polyurethane increases in many cases. In addition, any one of the methods causes a reaction between isocyanates at a high ratio in many cases, with the result that a urea bond or allophanate bond having high polarity occurs.

A difference in polarity between the polyol and the isocyanate can be reduced by thermally curing: the polyether diol having the structure of the structural formula (a), and at least one structure selected from the structural formulae (b) and (c), or the hydroxyl group-terminated prepolymer obtained by causing the polyether diol and the aromatic diisocyanate to react with each other; and the isocyanate group-terminated prepolymer obtained by causing the polyether diol and the aromatic isocyanate to react with each other.

Accordingly, the compatibility between the polyol and the isocyanate is improved, and hence a polyurethane having lower polarity is obtained with a smaller isocyanate ratio than that of a conventional example. Further, the sticking of the toner to the surface due to the bleeding of the unreacted polyol can be suppressed because the remaining of the unreacted polyol can be suppressed to an extremely low level.

Further, when the silicone rubber is used in the elastic layer in the developing roller according to the present invention, the surface layer containing the polyurethane according to the present invention shows excellent bonding property for the elastic layer. This may be because of the following reason. The polyurethane according to the present invention, which is a urethane resin having the structure represented by the structural formula (a), and at least one structure selected from the group consisting of the structure represented by the structural formula (b) and the structure represented by the structural formula (c) present between adjacent urethane bonds, has extremely low polarity for a polyurethane as compared with a conventional polyether polyurethane by virtue of the introduction of a methyl group to a side chain thereof. Meanwhile, it has been known that the cured substance of the addition-curing-type dimethyl silicone rubber has a "helical" molecular structure in which six siloxane (Si—O) bonds correspond to one rotation, and that a methyl group thereof orients outward. In other words, the surface of the polymer chain of the silicone rubber is substantially coated with a hydrophobic methyl group. Accordingly, an attraction that acts between hydrophobic molecules acts between a methyl group on the surface of the silicone rubber in the elastic layer according to the present invention and a methyl group as a side chain introduced between the two adjacent urethane bonds in the urethane resin in the surface layer. As a result, the surface layer and elastic layer according to the present invention show excellent bonding properties.

The difference in polarity between the polyol and the isocyanate can be reduced by thermally curing: the polyether diol having the structure of the structural formula (a), and at least one structure selected from the structural formulae (b) and (c), or the hydroxyl group-terminated prepolymer obtained by causing the polyether diol and the aromatic diisocyanate to react with each other; and the isocyanate group-terminated prepolymer obtained by causing the polyether diol and the aromatic isocyanate to react with each other. Accordingly, the compatibility between the polyol and the isocyanate is improved, and hence a polyurethane having lower polarity is obtained with a smaller isocyanate ratio than a conventional one. Further, the sticking of the toner due to the bleeding of the unreacted polyol can be suppressed because the remaining of the unreacted polyol can be suppressed to an extremely low level.

When the polyether diol formed of the structure of the structural formula (a) and the structure of the structural formula (b) or (c) is used as the hydroxyl group-terminated prepolymer obtained through the reaction with the aromatic diisocyanate, the number average molecular weight of the prepolymer is preferably 10,000 or more and 15,000 or less.

In addition, when the polyether diol is used as the isocyanate group-terminated prepolymer, the isocyanate content of the prepolymer preferably falls within the range of 3.0 to 4.0 mass %. When the molecular weight of the hydroxyl group-terminated prepolymer and the isocyanate content of the isocyanate group-terminated prepolymer fall within the ranges, a good balance is established between a reduction in coefficient of water absorption of the polyurethane to be produced and the suppression of the remaining of the unreacted component, and hence an additionally high level of compatibility between the suppressing effects on the sticking of the toner and the peeling of the surface layer can be achieved.

In addition, the polyurethane is more preferably obtained by thermally curing the following.

A hydroxy group-terminated prepolymer having a number average molecular weight of 10,000 or more and 15,000 or less and obtained by a reaction of a polyether diol and an aromatic diisocyanate, in which the polyether diol has a number average molecular weight of 2,000 or more and 3,000 or less and has a structure of the structural formula (a) and at least one structure selected from the structural formulae (b) and (c)

A isocyanate-terminated prepolymer obtained by a reaction of a polyether diol and an aromatic isocyanate, in which the polyether diol has a number average molecular weight of 2,000 or more and 3,000 or less and has a structure of the structural formula (a) and at least one structure selected from the structural formulae (b) and (c)

The use of the hydroxyl group-terminated prepolymer and the isocyanate group-terminated prepolymer each produced using the polyether diol having a number average molecular weight of 2,000 or more and 3,000 or less can reduce the coefficient of water absorption of the polyurethane to be produced and suppress the remaining of the unreacted component. Further, the use provides excellent strength and tackiness of the surface layer and hence can improve durability as well.

In addition to the structure of the structural formula (a), and at least one structure selected from the structural formulae (b) and (c), a polypropylene glycol or an aliphatic polyester may be incorporated as required between the two urethane bonds as long as the effect of the present invention is not impaired. The aliphatic polyester is, for example, an aliphatic polyester polyol obtained through a condensation reaction of a diol component such as 1,4-butanediol, 3-methyl-1,5-pentanediol, or neopentyl glycol, a triol component such as trimethylolpropane, with a dicarboxylic acid such as adipic acid, glutaric acid, or sebacic acid.

The polyol component may be formed in advance into a chain extension prepolymer with an isocyanate such as 2,4-tolylene diisocyanate (TDI), 1,4-diphenylmethane diisocyanate (MDI), or isophorone diisocyanate (IPDI) as required.

The content of the components except the structure of the structural formula (a), and at least one structure selected from the structural formulae (b) and (c) in the polyurethane is preferably set to 20 mass % or less from the viewpoint of exerting the effect of the present invention.

The isocyanate compound to be caused to react with these polyol components is not particularly limited and examples thereof include: aliphatic polyisocyanates such as ethylene diisocyanate and 1,6-hexamethylene diisocyanate (HDI); alicyclic polyisocyanates such as isophorone diisocyanate (IPDI), cyclohexane 1,3-diisocyanate, and cyclohexane 1,4-diisocyanate; aromatic isocyanates such as 2,4-tolylene diisocyanate, 2,6-tolylene diisocyanate (TDI), 4,4'-diphenylmethane diisocyanate (MDI), polymeric diphenylmethane diisocyanate, xylylene diisocyanate, and naphthalene diisocyanate; and a copolymer thereof, an isocyanurate thereof, a TMP adduct thereof, a biuret compound thereof, and a block compound thereof.

Of those, there are more suitably used an aromatic isocyanates such as tolylene diisocyanate, diphenylmethane diisocyanate, and polymeric diphenylmethane diisocyanate.

The polyurethane obtained by causing the aromatic isocyanate, and the polyether component having, between the urethane bonds, the structure of the structural formula (a), and at least one structure selected from the structural formulae (b) and (c) to react with each other is preferred because the polyurethane is flexible and excellent in strength, and has low tackiness under high temperature and high humidity.

A mixing ratio between the isocyanate compound to be caused to react with the polyol component and the polyol component in terms of an isocyanate group ratio preferably falls within the range of 1.2 to 4.0 with respect to 1.0 of a hydroxyl group of the polyol.

The surface layer 13 preferably has conductivity. Process for imparting the conductivity is, for example, the addition of an ionic conductive agent or electronic conductive fine particles. Of those, the electronic conductive fine particles are suitably used because the fine particles are available at a low cost and each show a small fluctuation in resistance due to an environment, and carbon black is particularly preferred from the viewpoints of conductivity-imparting property and reinforcing property. With regard to the properties of the electronic conductive fine particles, carbon black having a primary particle diameter of 18 nm or more and 50 nm or less, and a DBP oil absorption of 50 ml/100 g or more and 160 ml/100 g or less is preferred because a balance among its conductivity, hardness, and dispersibility is good. The content of the electronic conductive fine particles is preferably 10 mass % or more and 30 mass % or less with respect to 100 parts by mass of the resin component forming the surface layer.

The surface layer 13 of the developing roller in the present invention has an elastic modulus at 5° C. of preferably 100 MPa or more and 1,000 MPa or less, more preferably 200 MPa or more and 800 MPa or less. Setting the elastic modulus of the surface layer within the range can secure the area of contact between the developing roller and the toner at the abutment portion of the toner regulating member and the developing roller even under a low-temperature environment, and hence can suppress a reduction in charge quantity of the toner. In addition, the setting can prevent the application of an excessive stress to the toner when the toner is sandwiched between the developing roller and the toner regulating member, and can reduce the tackiness of the surface of the developing roller. Accordingly, the filming of the toner to the surface of the developing roller can be effectively suppressed.

When the developing roller is required to have a surface roughness, fine particles for roughness control may be added to the surface layer 13. The fine particles for roughness control preferably have a volume average particle diameter of 3 to 20 μm. In addition, the addition amount of the particles to be added to the surface layer is preferably 1 to 50 parts by mass with respect to 100 parts by mass of the resin solid content of the surface layer. Fine particles of a polyurethane resin, a polyester resin, a polyether resin, a polyamide resin, an acrylic resin, or a phenol resin can be used as the fine particles for roughness control.

The thickness of the surface layer 13 is preferably 1.0 μm to 500.0 μm, more preferably 1.0 μm to 50.0 μm. Setting the thickness of the surface layer 13 to 1.0 μm or more can impart durability to the developing roller. In addition, setting the thickness of the surface layer 13 to 500.0 μm or less, more preferably 50.0 μm or less can suppress the deterioration of the toner, thereby enabling stable formation of images over a long time period. The thickness of the surface layer 13 in the present invention is the arithmetic average of five arbitrary distances from an interface between the surface layer and the elastic layer to a flat portion on the surface of the surface layer obtained by observing a section in the thickness direction of the surface layer with a digital microscope VHX-600 manufactured by KEYENCE CORPORATION.

A method of forming the surface layer 13 is, for example, but not particularly limited to, spray coating, dip coating, or roll coating with a paint. When the dip coating is employed as a method of forming the surface layer, such a method involving overflowing the paint from the upper end of a dipping tank as described in Japanese Patent Application Laid-Open No. S57-5047 is simple and excellent in production stability.

(Measurement of Molecular Weight of Copolymer)

An apparatus used in the measurement of a number average molecular weight (Mn) and weight average molecular weight (Mw) in this example, and conditions for the measurement are as described below.

Measuring instrument: HLC-8120GPC (manufactured by TOSOH CORPORATION)

Columns: TSKgel SuperHZMM (manufactured by TOSOH CORPORATION)×2

Solvent: THF (having added thereto 20 mmol/L of triethylamine)

Temperature: 40° C.

Flow rate of THF: 0.6 ml/min

It should be noted that a measurement sample was a 0.1-mass % THF solution. Further, the measurement was performed with a refractive index (RI) detector as a detector.

A calibration curve was created with TSK Standard Polystyrenes A-1000, A-2500, A-5000, F-1, F-2, F-4, F-10, F-20, F-40, F-80, and F-128 (manufactured by TOSOH CORPORATION) as standard samples for creating the calibration curve. The weight average molecular weight was determined from the retention time of the measurement sample based on the obtained curve.

(Measurement of Elastic Modulus of Surface Layer)

Used as the elastic modulus of the surface layer 13 of the developing roller in the present invention was a value for a composite elastic modulus measured with a nanoindentation measuring apparatus (Tribo Scope manufactured by Hysitron Inc.+NanoNavi Station+E-sweep model manufactured by SII NanoTechnology Inc.).

A nanoindentation method is a method involving measuring a relationship between a load and a displacement in a time period commencing on the pushing (indentation) of an indenter made of diamond into the surface of the sample under a load of up to a certain value and ending on the removal (unloading) of the indenter. An indentation curve to be obtained at this time reflects the elastoplastic deformation behavior of the material, and an unloading curve to be obtained at this time reflects the elastic recovery behavior thereof. Therefore, the composite elastic modulus can be calculated from the initial gradient of the unloading curve.

In the present invention, the measurement was performed according to the following procedure by a method in conformity with ISO 14577.

Produced was a 5-mm square sample having a thickness of 2 mm cut out of the surface of the developing roller so as to include the surface layer. Next, after the temperature of the sample had been controlled to 5° C. in a vacuum, three portions having no resin particles present on their surfaces were subjected to measurement with the nanoindentation measuring apparatus, and an arithmetic average calculated from the resultant composite elastic moduluses was defined as the elastic modulus of the surface layer of the developing roller. It should be noted that the amount in which the indenter was indented into the surface of the sample at the time of the measurement was set to 300 nm.

<Developing Unit and Electrophotographic Image Forming Apparatus>

The schematic construction of a developing unit 1 of the present invention is described with reference to FIG. 1. A developing method in this example is a contact developing system involving using a nonmagnetic one-component toner.

The developing unit 1 is provided with a toner container 4 storing a toner 2 and the developing roller 10 that is rotationally driven in a direction indicated by an arrow A so as to close the opening of the toner container. In addition, a toner regulating member 3 for triboelectrically charging toner on the developing roller 10, and at the same time, for controlling a toner amount to form a thin-layer-like toner layer is provided so as to abut on the developing roller 10.

In the toner container 4, a toner supplying roller 5 that is rotationally driven in a direction indicated by an arrow B for supplying the toner 2 to the developing roller 10, and at the same time, for scraping off the toner 2 remaining on the developing roller 10 after development without being used is provided so as to abut on the developing roller 10. In addition, a blade-like toner stirring member 6 that is rotationally driven in a direction indicated by an arrow E for stirring the toner 2 and supplying the toner to the toner supplying roller 5 is provided.

The toner regulating member 3 is a flat spring made of SUS, and is placed in a bent state within its elastic range so as to abut on the developing roller 10 at a predetermined abutment pressure.

The toner supplying roller 5 is an elastic roller made of a conductive sponge and is placed while being caused to encroach on the developing roller 10.

Figure 4:
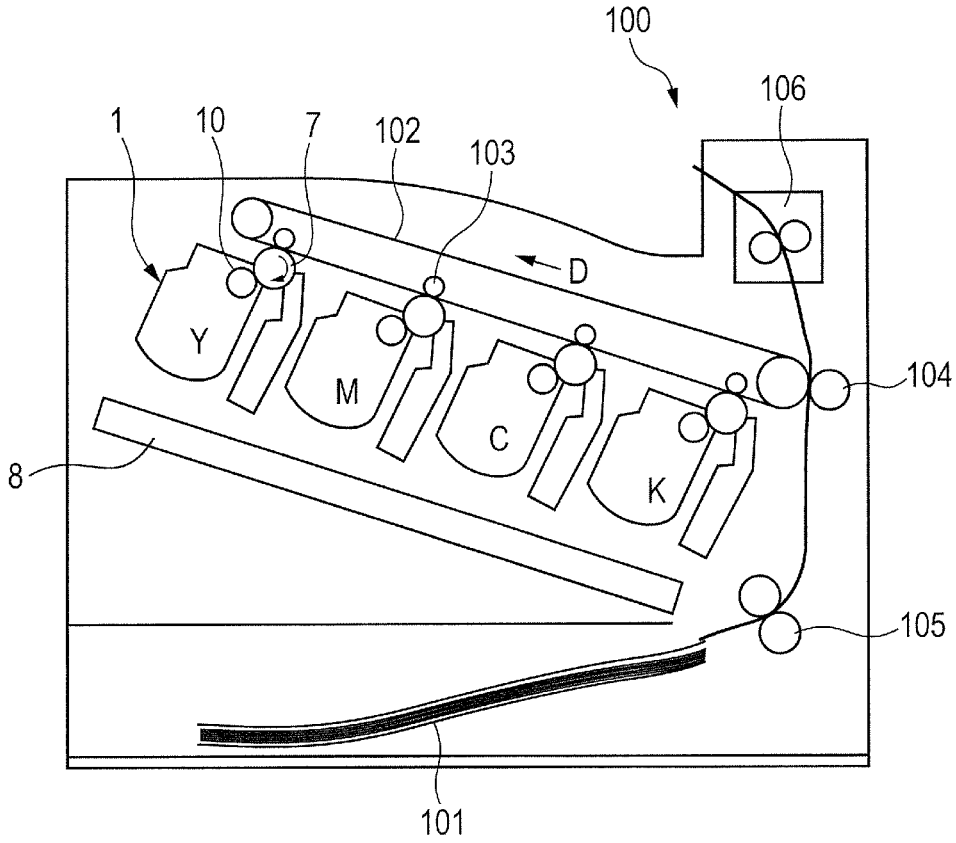
FIG. 4 is a schematic construction view illustrating an example of an electrophotographic image forming apparatus according to the present invention.

Next, an example of an electrophotographic image forming apparatus mounted with the developing unit of the present invention is described with reference to FIG. 4.

An electrophotographic image forming apparatus 100 is a color laser printer employing a transfer-system electrophotographic process, a contact charging system, and a one-component contact developing system. The electrophotographic image forming apparatus 100 can form and output a full-color image on a transfer material 101 as a recording medium such as paper or an OHP sheet according to image information from an external host apparatus (not shown) connected thereto so as to be communicable.

In addition, the electrophotographic image forming apparatus 100 is an image forming apparatus of a quadruple-drum system (inline system) for obtaining a full-color printed image. That is, the electrophotographic image forming apparatus 100 has multiple image forming portions for forming images of respective colors, i.e., yellow (Y), magenta (M), cyan (C), and black (K) colors as image forming device. Images formed by the respective image forming portions are once subjected to multilayer transfer onto an intermediate transfer belt 102 as an intermediate transfer member. After that, the images are collectively transferred onto the transfer material 101 as a recording medium such as paper. The intermediate transfer belt 102 is suspended on a driving roller and a supporting roller, and is driven in a direction indicated by an arrow D.

The image forming portions for the respective colors are of the same construction, and each have a drum-type electrophotographic photosensitive member (hereinafter referred to as "photosensitive drum") 7 as an image bearing member for bearing an electrostatic latent image, the member being rotationally driven in a direction indicated by an arrow. A charging roller (not shown) as charging device and a laser beam scanner unit 8 as exposing device are placed around the photosensitive drum 7, and form an electrostatic latent image on the photosensitive drum 7. The developing unit 1 as developing device is further placed around the photosensitive drum 7 and develops the electrostatic latent image formed on the photosensitive drum 7 to form a visible image (toner image). In addition, a cleaning unit (not shown) as cleaning device for cleaning a residual toner image on the photosensitive drum 7 is placed around the photosensitive drum 7.

The developing unit 1, the photosensitive drum 7, the charging roller (not shown), and the cleaning unit (not shown) constituting each image forming portion are integrally constituted to provide a process cartridge. Each process cartridge is detachably mountable to the main body of the electrophotographic image forming apparatus 100 through mounting device (not shown). Therefore, when the developing unit 1 in the process cartridge comes to a close owing to toner consumption, the image forming portion, i.e., the process cartridge can be replaced.

Image formation is performed as described below. In each image forming portion, the surface of the photosensitive drum 7 is uniformly charged by the charging unit (not shown) for charging an image bearing member, a latent image according to an input signal from a controller is formed on the charged surface by the exposing unit 8 for forming an electrostatic latent image, and the electrostatic latent image is developed with toner to be visualized as a toner image by the developing unit 1 for forming a toner image. The image forming process is performed for each color.

The toner images of the respective colors are transferred onto the intermediate transfer belt 102 in a primary transfer portion where a primary transfer roller 103 as transferring device is placed, and then color images are formed on the intermediate transfer belt 102. The color images are collectively transferred onto the transfer material 101 in a secondary transfer portion where a secondary transfer roller 104 as secondary transferring device is placed. The transfer material 101 is conveyed from a sheet feeding cassette to the secondary transfer portion provided with the transfer roller 104 by a conveying roller 105 as conveying device.

The transfer material 101 onto which the color images have been transferred is conveyed to a fixing unit 106 and then the toner images are fixed by the fixing unit 106, followed by the discharge of the transfer material. Meanwhile, transfer residual toner remaining on the photosensitive drum 7 after the transfer is cleaned by the cleaning unit (not shown).

EXAMPLES

Hereinafter, the present invention is described in detail based on examples and comparative examples.

Although the following examples are examples of the embodiment of the present invention, the present invention is not limited by these examples.

<Toner>

(Toner (A))

A toner (A) was produced according to the following procedure.

9 Parts by mass of tricalcium phosphate and 11 parts by mass of 10% hydrochloric acid were added to 1,300 parts by mass of ion-exchanged water warmed to a temperature of 60° C., and then the mixture was stirred with a TK-type homomixer (manufactured by Tokushu Kika Kogyo) at 10,000 r/min to prepare an aqueous dispersion medium having a pH of 5.2.

In addition, the following materials were stirred with a propeller-type stirring apparatus at 100 r/min to prepare a solution.

Styrene; 69.0 parts by mass n-Butyl acrylate; 31.0 parts by mass

Divinylbenzene; 0.023 part by mass

Sulfonic acid group-containing resin (acrylic base FCA-1001-NS manufactured by Fujikura Kasei Co., Ltd.); 2.0 parts by mass Styrene-methacrylic acid-methyl methacrylate-α-methylstyrene copolymer; 20.0 parts by mass (styrene/methacrylic acid/methyl methacrylate/α-methylstyrene=80.85/2.50/1.65/15.0, Mp=19,700, Mw=7,900, TgB=96° C., acid value=12.0 mgKOH/g, Mw/Mn=2.1)

Next, the following materials were added to the solution.

C.I. Pigment Blue 15:3; 7.0 parts by mass

Negative charge control agent (BONTRON E-88 manufactured by ORIENT CHEMICAL INDUSTRIES CO., LTD.); 1.0 part by mass Hydrocarbon wax having peak temperature of maximum endothermic peak of 77° C. (HNP-51 manufactured by NIPPON SEIRO CO., LTD.); 8.0 parts by mass After that, the mixed liquid was warmed to a temperature of 60° C., and then the contents were dissolved and dispersed by stirring the mixed liquid with a TK-type homomixer (manufactured by Tokushu Kika Kogyo) at 9,000 r/min.

8.0 Parts by mass of a polymerization initiator 2,2'-azobis (2,4-dimethylvaleronitrile) were dissolved in the resultant to prepare a polymerizable monomer composition. The polymerizable monomer composition was loaded into the aqueous dispersion medium, and then the mixture was stirred and granulated with a TK-type homomixer at 15,000 r/min for 10 minutes at a temperature of 60° C.

After that, the granulated product was transferred to a propeller-type stirring apparatus and then subjected to a reaction at a temperature of 70° C. for 5 hours while being stirred at 100 r/min. After that, the temperature was increased to 80° C. and then the reaction was performed for an additional five hours. Thus, toner particles were produced. After the completion of the polymerization reaction, a slurry containing the toner particles was cooled and then washing with water in an amount tenfold that of the slurry is performed. The resultant was filtered and dried, followed by the adjustment of particle diameters through classification. Thus, toner particles were obtained.

100 Parts by mass of the toner particles, and 2.0 parts by mass of a hydrophobic silica fine powder treated with a dimethyl silicone oil (20 mass %) and triboelectrically charged to the same polarity (negative polarity) as that of the toner particles (number average primary particle diameter: 10 nm, BET specific surface area: 170 $m^2/g$) as a flowability improver were mixed with a Henschel mixer (manufactured by MITSUI MIIKE MACHINERY Co., Ltd.) at 3,000 r/min for 15 minutes. Thus, the toner (A) was obtained. Table 1 shows the physical properties of the toner (A).

Next, the content of divinylbenzene of the toner (A) was measured. The content of divinylbenzene was measured with a gas chromatography-mass spectrometer provided with a pyrolyzer.

A "PYROFOIL SAMPLER JPS-700" manufactured by Japan Analytical Industry Co., Ltd. was used as the pyrolyzer and a "Trace GCMS" manufactured by Thermo Fischer Scientific K.K. was used as the gas chromatography-mass spectrometer. With regard to the sample, 0.1 mg of the sample was wrapped with a pyrofoil at 590° C. and set in the pyrolyzer. Conditions for the GC/MS were as described below. Used as a column was an "HP-INNOWAX" manufactured by Agilent Technologies having a column length of 30 m, an inner diameter of 0.25 mm, and a liquid phase of 0.25 μm. The temperature of the column was increased under the following conditions: the temperature was increased from 50° C. to 120° C. at 5° C./min, increased to 200° C. at 10° C./min, and held at 200° C. for 3 minutes. It should be noted that conditions for the inlet of the GC/MS were as follows: an inlet temperature of 200° C., split analysis, a split flow of 50 mL/min, and an inlet pressure of 100 kPa.

The content was calculated by comparing the integrated value of the peak of divinylbenzene detected when the analysis was performed under the foregoing conditions with a calibration curve created in advance.

As a result, the content of divinylbenzene in the binder resin of the toner (A) was 0.022 mass %.

(Toner (B))

Production was performed in the same manner as in the toner (A) except that in the toner (A), the addition amount of divinylbenzene was changed to 0.013 part by mass. The resultant toner is defined as a toner (B). In addition, Table 1 shows the physical properties of the toner (B).

Next, the content of divinylbenzene was measured in the same manner as in the toner (A). As a result, the content of divinylbenzene in the binder resin of the toner (B) was 0.012 mass %.

(Toner (C))

Production was performed in the same manner as in the toner (A) except that in the toner (A), the addition amount of divinylbenzene was changed to 0.0050 part by mass. The resultant toner is defined as a toner (C). In addition, Table 1 shows the physical properties of the toner (C).

Next, the content of divinylbenzene was measured in the same manner as in the toner (A). As a result, the content of divinylbenzene in the binder resin of the toner (C) was 0.0050 mass %.

(Toner (D))

Production was performed in the same manner as in the toner (A) except that in the toner (A), divinylbenzene was not added. The resultant toner is defined as a toner (D). In addition, Table 1 shows the physical properties of the toner (D).

(Toner (E))

Production was performed in the same manner as in the toner (D) except that in the toner (D), the addition amount of styrene was changed to 66.0 parts by mass and the addition amount of n-butyl acrylate was changed to 34 parts by mass. The resultant toner is defined as a toner (E). In addition, Table 1 shows the physical properties of the toner (E).

(Toner (F))

Production was performed in the same manner as in the toner (D) except that in the toner (D), the addition amount of styrene was changed to 64.0 parts by mass, the addition amount of n-butyl acrylate was changed to 36.0 parts by mass, and the wax was changed to a hydrocarbon wax having a peak temperature of the maximum endothermic peak of 74° C. (Biber TM103 manufactured by Toyo Petrolite Co., Ltd.).

The resultant toner is defined as a toner (F). In addition, Table 1 shows the physical properties of the toner (F).

(Toner (G))

Production was performed in the same manner as in the toner (D) except that in the toner (D), the sulfonic acid group-containing resin (acrylic base FCA-1001-NS manufactured by Fujikura Kasei Co., Ltd.) was not added. The resultant toner is defined as a toner (G). In addition, Table 1 shows the physical properties of the toner (G).

(Toner (H))

Production was performed in the same manner as in the toner (D) except that in the toner (D), 8.0 parts by mass of behenyl behenate (ester wax) having a peak temperature of the maximum endothermic peak of 75° C. were added instead of the hydrocarbon wax. The resultant toner is defined as a toner (H). In addition, Table 1 shows the physical properties of the toner (H).

(Toner (I))

Production was performed in the same manner as in the toner (D) except that in the toner (D), the addition amount of the hydrocarbon wax was changed to 3.0 parts by mass. The resultant toner is defined as a toner (I). In addition, Table 1 shows the physical properties of the toner (I).

(Toner (J))

Production was performed in the same manner as in the toner (D) except that in the toner (D), the addition amount of the hydrocarbon wax was changed to 27.0 parts by mass. The resultant toner is defined as a toner (J). In addition, Table 1 shows the physical properties of the toner (J).

(Toner (K))

Production was performed in the same manner as in the toner (D) except that in the toner (D), the hydrochloric acid was not added in the step of producing an aqueous dispersion medium and the toner production was performed in an aqueous dispersion medium having a pH of 11.0. The resultant toner is defined as a toner (K). In addition, Table 1 shows the physical properties of the toner (K).

(Toner (L))

Production was performed in the same manner as in the toner (D) except that in the toner (D), 20.0 parts by mass of a styrene-methacrylic acid-methyl methacrylate-butyl acrylate copolymer having a TgB of 76° C. (styrene/methacrylic acid/methyl methacrylate/butyl acrylate=83.85/2.50/1.65/12.00) were added instead of the styrene-methacrylic acid-methyl methacrylate-α-methylstyrene copolymer. The resultant toner is defined as a toner (L). In addition, Table 1 shows the physical properties of the toner (L).

(Toner (M))

Production was performed in the same manner as in the toner (D) except that in the toner (D), 20.0 parts by mass of a styrene-methyl methacrylate-acryloyl morpholine copolymer having a TgB of 124° C. (styrene/methyl methacrylate/acryloyl morpholine=20.00/30.00/50.00) were added instead of the styrene-methacrylic acid-methyl methacrylate-α-methylstyrene copolymer. The resultant toner is defined as a toner (M). In addition, Table 1 shows the physical properties of the toner (M).

(Toner (N))

Production was performed in the same manner as in the toner (D) except that in the toner (D), the addition amount of tricalcium phosphate was changed to 10.8 parts by mass, the addition amount of the 10% hydrochloric acid was changed to 13.2 parts by mass, and 1.0 part by mass of t-dodecyl mercaptan was added. The resultant toner is defined as a toner (N). In addition, Table 1 shows the physical properties of the toner (N).

(Toner (O))

Production was performed in the same manner as in the toner (D) except that in the toner (D), the addition amount of tricalcium phosphate was changed to 7.2 parts by mass, the addition amount of the 10% hydrochloric acid was changed to 8.8 parts by mass, the addition amount of styrene was changed to 78.0 parts by mass, and the addition amount of n-butyl acrylate was changed to 22.0 parts by mass. The resultant toner is defined as a toner (O). In addition, Table 1 shows the physical properties of the toner (O).

(Toner (P))

Production was performed in the same manner as in the toner (D) except that in the toner (D), 20.0 parts by mass of a styrene-methyl methacrylate-acryloyl morpholine copolymer having a TgB of 132° C. (styrene/methyl methacrylate/acryloyl morpholine=3.00/30.00/67.00) were added instead of the styrene-methacrylic acid-methyl methacrylate-α-methylstyrene copolymer. The resultant toner is defined as a toner (P). In addition, Table 1 shows the physical properties of the toner (P).

(Toner (Q))

Production was performed in the same manner as in the toner (D) except that in the toner (D), the wax was changed to a hydrocarbon wax having a peak temperature of the maximum endothermic peak of 88° C. (Polywax TM500 manufactured by Toyo Petrolite Co., Ltd.). The resultant toner is defined as a toner (Q). In addition, Table 1 shows the physical properties of the toner (Q).

(Toner (R))

Production was performed in the same manner as in the toner (D) except that in the toner (D), the wax was changed to a hydrocarbon wax having a peak temperature of the maximum endothermic peak of 107° C. (Polywax TM850 manufactured by Toyo Petrolite Co., Ltd.). The resultant toner is defined as a toner (R). In addition, Table 1 shows the physical properties of the toner (R).

(Toner (S))

Production was performed in the same manner as in the toner (D) except that in the toner (D), the addition amount of styrene was changed to 64.0 parts by mass, the addition amount of n-butyl acrylate was changed to 36.0 parts by mass, and the wax was changed to a hydrocarbon wax having a peak temperature of the maximum endothermic peak of 107° C. (Polywax TM850 manufactured by Toyo Petrolite Co., Ltd.). The resultant toner is defined as a toner (S). In addition, Table 1 shows the physical properties of the toner (S).

(Toner (T))

Production was performed in the same manner as in the toner (D) except that in the toner (D), 20.0 parts by mass of a styrene-methacrylic acid-methyl methacrylate-butyl acrylate copolymer having a TgB of 71° C. (styrene/methacrylic acid/methyl methacrylate/butyl acrylate=78.05/2.5/1.65/17.8) were added instead of the styrene-methacrylic acid-methyl methacrylate-α-methylstyrene copolymer. The resultant toner is defined as a toner (T). In addition, Table 1 shows the physical properties of the toner (T).

(Toner (a))

Production was performed in the same manner as in the toner (D) except that in the toner (D), the addition amount of styrene was changed to 83.0 parts by mass, the addition amount of n-butyl acrylate was changed to 17.0 parts by mass, 8.0 parts by mass of stearyl behenate (ester wax) having a peak temperature of the maximum endothermic peak of 69° C. was added instead of the hydrocarbon wax, and 8.0 parts by mass of a polyester resin (polycondensate of propylene oxide-modified bisphenol A and isophthalic acid, TgB=65° C., Mw=10,000, Mn=6,000) were added instead of the styrene-methacrylic acid-methyl methacrylate-α-methylstyrene copolymer. The resultant toner is defined as a toner (a). In addition, Table 1 shows the physical properties of the toner (a).

(Toner (b))

Production was performed in the same manner as in the toner (D) except that in the toner (D), 20.0 parts by mass of a styrene-methacrylic acid-methyl methacrylate-butyl acrylate copolymer having a TgB of 67° C. (styrene/methacrylic acid/methyl methacrylate/butyl acrylate=72.35/2.50/1.65/23.50) were added instead of the styrene-methacrylic acid-methyl methacrylate-α-methylstyrene copolymer. The resultant toner is defined as a toner (b). In addition, Table 1 shows the physical properties of the toner (b).

(Toner (c))

Production was performed in the same manner as in the toner (D) except that in the toner (D), the polymerization was performed by adding 5 parts by mass of an unsaturated polar resin (Atlac 382A manufactured by Kao Corporation). The resultant toner is defined as a toner (c). In addition, Table 1 shows the physical properties of the toner (c).

(Toner (d))

Production was performed in the same manner as in the toner (D) except that in the toner (D), 8.0 parts by mass of a polyester resin (polycondensate of propylene oxide-modified bisphenol A and isophthalic acid, TgB=65° C., Mw=10,000, Mn=6,000) were added instead of the styrene-methacrylic acid-methyl methacrylate-α-methylstyrene copolymer. The resultant toner is defined as a toner (d). In addition, Table 1 shows the physical properties of the toner (d).

(Toner (e))

Production was performed in the same manner as in the toner (D) except that in the toner (D), the addition amount of divinylbenzene was changed to 1.0 part by mass. The resultant toner is defined as a toner (e). In addition, Table 1 shows the physical properties of the toner (e).

Next, the content of divinylbenzene was measured in the same manner as in the toner (A). As a result, the content of divinylbenzene in the binder resin of the toner (e) was 0.98 mass %.

(Toner (f))

Production was performed in the same manner as in the toner (D) except that in the toner (D), the addition amount of styrene was changed to 55.0 parts by mass and the addition amount of n-butyl acrylate was changed to 45.0 parts by mass. The resultant toner is defined as a toner (f). In addition, Table 1 shows the physical properties of the toner (f).

(Toner (g))

Production was performed in the same manner as in the toner (D) except that in the toner (D), the wax was changed to a Fischer-Tropsch wax as a hydrocarbon wax having a peak temperature of the maximum endothermic peak of 55° C. (WEISSEN-T-0453 manufactured by NIPPON SEIRO CO., LTD.). The resultant toner is defined as a toner (g). In addition, Table 1 shows the physical properties of the toner (g).

(Toner (h))

Production was performed in the same manner as in the toner (D) except that in the toner (D), the polymerization was performed by adding 1.0 part by mass of divinylbenzene and 8 parts by mass of an unsaturated polar resin (Atlac 382A manufactured by Kao Corporation). The resultant toner is defined as a toner (h). In addition, Table 1 shows the physical properties of the toner (h).

Next, the content of divinylbenzene was measured in the same manner as in the toner (A). As a result, the content of divinylbenzene in the binder resin of the toner (h) was 0.98 mass %.

(Toner (i))

Production was performed in the same manner as in the toner (D) except that in the toner (D), the wax was changed to a hydrocarbon wax having a peak temperature of the maximum endothermic peak of 113° C. (Polywax TM1000 manufactured by Toyo Petrolite Co., Ltd.). The resultant toner is defined as a toner (i). In addition, Table 1 shows the physical properties of the toner (i).

(Toner (j))

Production was performed in the same manner as in the toner (D) except that in the toner (D), the addition amount of styrene was changed to 80.0 parts by mass, the addition amount of n-butyl acrylate was changed to 20.0 parts by mass, and the wax was changed to a hydrocarbon wax having a peak temperature of the maximum endothermic peak of 105° C. (LUVAX-1151 manufactured by NIPPON SEIRO CO., LTD.). The resultant toner is defined as a toner (j). In addition, Table 1 shows the physical properties of the toner (j).

(Toner (k))

Production was performed in the same manner as in the toner (D) except that in the toner (D), the wax was changed to a hydrocarbon wax having a peak temperature of the maximum endothermic peak of 105° C. (LUVAX-1151 manufactured by NIPPON SEIRO CO., LTD.) and the addition amount of the polymerization initiator was changed to 15 parts by mass. The resultant toner is defined as a toner (k). In addition, Table 1 shows the physical properties of the toner (k).

TABLE 1

| | Microcompression test | | | DSC | | | | Viscosity measured | | Number average | Wax component | |
|---|---|---|---|---|---|---|---|---|---|---|---|---|
| Toner No. | R(25) × $10^{-3}$ | Z(25) | Z(50) | P1 | TgA | P1 − TgA | TgB | with flow tester at 100° C. (×$10^4$ Pa · s) | Average circularity | particle diameter of toner (D1) | Kind | Number of added parts |
| A | 1.26 | 68 | 48 | 77 | 45 | 32 | 96 | 1.9 | 0.982 | 5.1 | Hydrocarbon-based wax | 8 |
| B | 1.22 | 59 | 35 | 77 | 45 | 32 | 96 | 1.1 | 0.981 | 4.9 | Hydrocarbon-based wax | 8 |
| C | 1.19 | 56 | 27 | 77 | 45 | 32 | 96 | 0.9 | 0.980 | 5.0 | Hydrocarbon-based wax | 8 |
| D | 1.18 | 55 | 26 | 77 | 45 | 32 | 96 | 0.8 | 0.981 | 5.1 | Hydrocarbon-based wax | 8 |
| E | 0.64 | 46 | 20 | 77 | 45 | 32 | 96 | 0.5 | 0.981 | 4.8 | Hydrocarbon-based wax | 8 |
| F | 0.62 | 45 | 19 | 74 | 40 | 34 | 96 | 0.4 | 0.980 | 5.0 | Hydrocarbon-based wax | 8 |
| G | 1.18 | 55 | 30 | 77 | 45 | 32 | 96 | 0.9 | 0.983 | 5.2 | Hydrocarbon-based wax | 8 |
| H | 1.18 | 55 | 26 | 75 | 45 | 30 | 96 | 0.8 | 0.980 | 5.1 | Ester wax | 8 |

TABLE 1-continued

| Toner No. | Microcompression test R(25) × $10^{-3}$ | Z(25) | Z(50) | DSC P1 | TgA | P1 − TgA | TgB | Viscosity measured with flow tester at 100° C. (×$10^4$ Pa · s) | Average circularity | Number average particle diameter of toner (D1) | Wax component Kind | Number of added parts |
|---|---|---|---|---|---|---|---|---|---|---|---|---|
| I | 1.18 | 55 | 26 | 77 | 45 | 32 | 96 | 0.7 | 0.986 | 5.0 | Hydrocarbon-based wax | 3 |
| J | 1.18 | 55 | 26 | 77 | 45 | 32 | 96 | 0.8 | 0.975 | 5.0 | Hydrocarbon-based wax | 27 |
| K | 1.18 | 55 | 26 | 77 | 45 | 32 | 96 | 0.8 | 0.956 | 6.3 | Hydrocarbon-based wax | 8 |
| L | 1.18 | 55 | 26 | 77 | 45 | 32 | 76 | 0.8 | 0.970 | 5.3 | Hydrocarbon-based wax | 8 |
| M | 1.18 | 55 | 26 | 77 | 45 | 32 | 124 | 0.8 | 0.980 | 5.0 | Hydrocarbon-based wax | 8 |
| N | 1.18 | 55 | 26 | 77 | 45 | 32 | 96 | 0.2 | 0.976 | 4.0 | Hydrocarbon-based wax | 8 |
| O | 1.11 | 74 | 34 | 77 | 59 | 18 | 96 | 2.3 | 0.981 | 7.5 | Hydrocarbon-based wax | 8 |
| P | 1.25 | 78 | 39 | 77 | 45 | 32 | 132 | 0.8 | 0.977 | 5.1 | Hydrocarbon-based wax | 8 |
| Q | 1.19 | 57 | 27 | 88 | 45 | 43 | 96 | 0.7 | 0.982 | 4.9 | Hydrocarbon-based wax | 8 |
| R | 1.21 | 56 | 29 | 107 | 45 | 62 | 96 | 1.1 | 0.977 | 4.8 | Hydrocarbon-based wax | 8 |
| S | 0.64 | 46 | 20 | 107 | 40 | 67 | 96 | 0.5 | 0.980 | 5.0 | Hydrocarbon-based wax | 8 |
| T | 0.60 | 49 | 13 | 77 | 45 | 32 | 71 | 1.9 | 0.980 | 5.2 | Hydrocarbon-based wax | 8 |
| a | 0.98 | 50 | 42 | 69 | 60 | 9 | 65 | 4.1 | 0.976 | 5.0 | Ester wax | 8 |
| b | 0.51 | 41 | 8 | 77 | 45 | 32 | 67 | 1.7 | 0.987 | 4.9 | Hydrocarbon-based wax | 8 |
| c | 1.66 | 74 | 57 | 77 | 45 | 32 | 96 | 2.8 | 0.980 | 4.9 | Hydrocarbon-based wax | 8 |
| d | 0.50 | 36 | 8 | 77 | 45 | 32 | 65 | 1.2 | 0.982 | 5.2 | Hydrocarbon-based wax | 8 |
| e | 1.25 | 85 | 39 | 77 | 45 | 32 | 96 | 13.2 | 0.977 | 5.0 | Hydrocarbon-based wax | 8 |
| f | 0.38 | 42 | 12 | 77 | 30 | 47 | 96 | 0.2 | 0.975 | 5.1 | Hydrocarbon-based wax | 8 |
| g | 1.20 | 55 | 28 | 55 | 45 | 10 | 96 | 0.3 | 0.983 | 5.2 | Hydrocarbon-based wax | 8 |
| h | 1.78 | 78 | 62 | 77 | 45 | 32 | 96 | 25.3 | 0.973 | 4.8 | Hydrocarbon-based wax | 8 |
| i | 1.21 | 57 | 28 | 113 | 45 | 68 | 96 | 1.1 | 0.972 | 4.9 | Hydrocarbon-based wax | 8 |
| j | 1.39 | 79 | 39 | 105 | 68 | 37 | 96 | 3.6 | 0.980 | 5.0 | Hydrocarbon-based wax | 8 |
| k | 0.72 | 41 | 8 | 107 | 40 | 67 | 96 | 0.3 | 0.978 | 5.1 | Hydrocarbon-based wax | 8 |

<Developing Roller>

The developing roller 10 was produced according to the following procedure.

(Preparation of Mandrel 11)

A product obtained by applying and baking a primer (trade name: DY35-051; manufactured by Dow Corning Toray Co., Ltd.) on a cored bar made of SUS304 with a diameter of 6 mm was prepared as the mandrel 11.

(Preparation of Elastic Layer 12)

Next, the mandrel 11 was placed in a die, and then an addition-type silicone rubber composition obtained by mixing the following materials was injected into a cavity formed in the die.

Liquid silicone rubber material (trade name: SE6724A/B; manufactured by Dow Corning Toray Co., Ltd.); 100 parts by mass Carbon black (trade name: TOKABLACK #4300; manufactured by TOKAI CARBON CO., LTD.); 15 parts by mass Silica powder as heat resistance-imparting agent; 0.2 part by mass Platinum catalyst; 0.1 part by mass Subsequently, the die was heated to subject the silicone rubber to vulcanization curing at 150° C. for 15 minutes, and then the cured substance was removed from the die. After that, the curing reaction was completed by heating the resultant at 180° C. for an additional one hour. Thus, the elastic layer 12 having a diameter of 12 mm was provided on the outer periphery of the mandrel 11.

(Preparation of Surface Layer 13)

A synthesis example for obtaining the polyurethane of the present invention is shown below.

(Synthesis of Polyether Diols A-1 to A-6)

In a reaction vessel, a mixture of 144.2 g (2 mol) of dry tetrahydrofuran and 172.2 g (2 mol) of dry 3-methyltetrahydrofuran (molar mixing ratio: 50/50) was held at a temperature of 10° C. 13.1 Grams of 70% perchloric acid and 120 g of acetic anhydride were added to the mixture, and then the resultant was subjected to a reaction for 1.5 hours. Next, purification was performed by pouring the reaction mixture into 600 g of a 20% aqueous solution of sodium hydroxide. Further, remaining water and the solvent component were removed under reduced pressure. Thus, a liquid polyether diol A-1 was obtained. Its number average molecular weight was 1,000.

Polyether diols A-2 to A-6 were obtained under the same conditions except that the molar mixing ratio between dry tetrahydrofuran and dry 3-methyltetrahydrofuran, and the reaction time were changed as shown in Table 2.

TABLE 2

| No. | Component | Chemical formula (1)/(2) or (3) | Mn | Reaction time |
|---|---|---|---|---|
| A-1 | Polyether diol | 50/50 | 1,000 | 1.5 h |
| A-2 | | | 2,000 | 2.5 h |
| A-3 | | | 3,000 | 4 h |
| A-4 | | | 4,000 | 6 h |
| A-5 | | 90/10 | 2,000 | 2.5 h |
| A-6 | | 80/20 | 2,000 | 2.5 h |

(Synthesis of Hydroxyl Group-Terminated Urethane Prepolymers A-7 to A-9)

Under a nitrogen atmosphere, in a reaction vessel, 200.0 g of the polyether diol A-1 were gradually dropped to 28.4 parts by mass of a Cosmonate MDI (trade name, manufactured by Mitsui Chemicals, Inc.) while the temperature in the reaction vessel was held at 65° C. After the completion of the dropping, the mixture was subjected to a reaction at a temperature of 75° C. for 3 hours. The resultant reaction mixture was cooled to room temperature. Thus, a hydroxyl group-terminated urethane prepolymer A-7 was obtained. Its number average molecular weight was 15,000.

Hydroxyl group-terminated urethane prepolymers A-8 and A-9 were obtained under the same conditions except that the polyether diol and the reaction time were changed as shown in Table 3.

TABLE 3

| No. | Component | Polyether diol | Chain extension isocyanate | Mn after prepolymer formation | Reaction time |
|---|---|---|---|---|---|
| A-7 | Hydroxyl group-terminated urethane prepolymer | A-1 | MDI | 15,000 | 3 h |
| A-8 | | A-2 | | 10,000 | 2 h |
| A-9 | | A-6 | | 15,000 | 3 h |

(Synthesis of Isocyanate Group-Terminated Prepolymer B-1)

Under a nitrogen atmosphere, in a reaction vessel, 200.0 g of a polypropylene glycol-based polyol (trade name: EXCENOL 1030; manufactured by Sanyo Chemical Industries, Ltd.) were gradually dropped to 69.6 parts by mass of a tolylene diisocyanate (TDI) Cosmonate 80 (trade name, manufactured by Mitsui Chemicals, Inc.) while the temperature in the reaction vessel was held at 65° C. After the completion of the dropping, the mixture was subjected to a reaction at a temperature of 65° C. for 2 hours. The resultant reaction mixture was cooled to room temperature. Thus, an isocyanate group-terminated urethane prepolymer B-1 having an isocyanate group content of 4.8% was obtained.

(Synthesis of Isocyanate Group-Terminated Prepolymers B-2 to B-4)

Under a nitrogen atmosphere, in a reaction vessel, 200.0 g of a polypropylene glycol-based polyol (trade name: EXCENOL 1030; manufactured by Sanyo Chemical Industries, Ltd.) were gradually dropped to 76.7 parts by mass of a Cosmonate MDI (trade name, manufactured by Mitsui Chemicals, Inc.) while the temperature in the reaction vessel was held at 65° C. After the completion of the dropping, the mixture was subjected to a reaction at a temperature of 65° C. for 2 hours. The resultant reaction mixture was cooled to room temperature. Thus, an isocyanate group-terminated urethane prepolymer B-2 having an isocyanate group content of 4.7% was obtained.

Isocyanate group-terminated urethane prepolymers B-3 and B-4 were obtained under the same conditions except that the polyether diol was changed as shown in Table 4.

(Synthesis of Isocyanate Group-Terminated Prepolymer B-5)

Under a nitrogen atmosphere, in a reaction vessel, 200.0 g of the polyether diol A-6 were gradually dropped to 46.4 parts by mass of a Coronate 2030 (trade name, manufactured by Nippon Polyurethane Industry Co., Ltd.) while the temperature in the reaction vessel was held at 65° C. After the completion of the dropping, the mixture was subjected to a reaction at a temperature of 65° C. for 2 hours. The resultant reaction mixture was cooled to room temperature. Thus, an isocyanate group-terminated urethane prepolymer B-5 having an isocyanate group content of 3.4% was obtained.

TABLE 4

| | Modified polyol | | | | |
|---|---|---|---|---|---|
| No. | No. | Mn | Chemical formula (1)/(2) or (3) | Isocyanate | NCO % |
| B-1 | PPG | 1,000 | — | TDI | 4.8 |
| B-2 | | | | Polymeric MDI | 4.7 |
| B-3 | A-6 | 2,000 | 80/20 | | 4.0 |
| B-4 | A-3 | 3,000 | 50/50 | | 3.8 |
| B-5 | A-6 | 2,000 | 80/20 | TDI | 3.4 |

(Developing Roller C-1)

100.0 Parts by mass of the polyol A-9, 6.7 parts by mass of the isocyanate B-4, and 21.2 parts by mass of a Carbon Black MA230 (trade name, manufactured by Mitsubishi Chemical Corporation) were stirred and mixed as materials for the surface layer 13.

Next, the resultant was dissolved in methyl ethyl ketone (hereinafter abbreviated as "MEK") so that the total solid content ratio was 30 mass %, followed by mixing. After that, the resultant was uniformly dispersed with a sand mill to provide a paint 1 for forming a surface layer. Next, the paint was diluted with MEK so as to have a viscosity of 5 to 7 cps, and then the surface of the elastic layer was coated with the diluted paint by dip coating, followed by drying. Further, a surface layer having a thickness of about 10 μm was provided on the outer periphery of the elastic layer by subjecting the resultant to a heating treatment at a temperature of 150° C. for 1 hour. Thus, a developing roller C-1 was produced. Table 5 shows the elastic modulus of the surface layer of the resultant developing roller.

(Developing Roller C-2)

A developing roller C-2 was produced in the same manner as in the developing roller C-1 except that in the developing roller C-1, the isocyanate was changed to the B-5 and its blending amount was changed as shown in Table 5. Table 5 shows the elastic modulus of the surface layer of the resultant developing roller.

(Developing Roller C-3)

A developing roller C-3 was produced in the same manner as in the developing roller C-1 except that in the developing roller C-1, the polyol was changed to the A-8, the isocyanate was changed to the B-2, and its blending amount was changed as shown in Table 5. Table 5 shows the elastic modulus of the surface layer of the resultant developing roller.

(Developing Roller C-4)

A developing roller C-4 was produced in the same manner as in the developing roller C-1 except that in the developing roller C-1, the polyol was changed to the A-5, the isocyanate was changed to the B-3, and its blending amount was changed as shown in Table 5. Table 5 shows the elastic modulus of the surface layer of the resultant developing roller.

(Developing Roller C-5)

A developing roller C-5 was produced in the same manner as in the developing roller C-4 except that in the developing roller C-4, the polyol was changed to the A-6. Table 5 shows the elastic modulus of the surface layer of the resultant developing roller.

(Developing Roller C-6)

A developing roller C-6 was produced in the same manner as in the developing roller C-4 except that in the developing roller C-4, the polyol was changed to the A-2. Table 5 shows the elastic modulus of the surface layer of the resultant developing roller.

(Developing Roller C-7)

A developing roller C-7 was produced in the same manner as in the developing roller C-1 except that in the developing roller C-1, the polyol was changed to the A-6, the isocyanate was changed to the B-5, and its blending amount was changed as shown in Table 5. Table 5 shows the elastic modulus of the surface layer of the resultant developing roller.

(Developing Roller C-8)

A developing roller C-8 was produced in the same manner as in the developing roller C-1 except that in the developing roller C-1, the polyol was changed to the A-1, the isocyanate was changed to a Polymeric MDI (trade name: MILLIONATE MR-200; manufactured by Nippon Polyurethane Industry Co., Ltd.), and its blending amount was changed as shown in Table 5. Table 5 shows the elastic modulus of the surface layer of the resultant developing roller.

(Developing Roller C-9)

A developing roller C-9 was produced in the same manner as in the developing roller C-1 except that in the developing roller C-1, the polyol was changed to the A-1, the isocyanate was changed to the B-1, and its blending amount was changed as shown in Table 5. Table 5 shows the elastic modulus of the surface layer of the resultant developing roller.

(Developing Roller C-10)

A developing roller C-10 was produced in the same manner as in the developing roller C-1 except that in the developing roller C-1, the polyol was changed to the A-4, the isocyanate was changed to the B-2, and its blending amount was changed as shown in Table 5. Table 5 shows the elastic modulus of the surface layer of the resultant developing roller.

(Developing Roller C-11)

A developing roller C-11 was produced in the same manner as in the developing roller C-1 except that in the developing roller C-1, the polyol was changed to the A-7, the isocyanate was changed to the B-1, and its blending amount was changed as shown in Table 5. Table 5 shows the elastic modulus of the surface layer of the resultant developing roller.

(Developing Roller C-12)

A developing roller C-12 was produced in the same manner as in the developing roller C-1 except that in the developing roller C-1, the polyol was changed to the A-3, the isocyanate was changed to the B-1, and its blending amount was changed as shown in Table 5. Table 5 shows the elastic modulus of the surface layer of the resultant developing roller.

(Developing Roller C-13)

A developing roller C-13 was produced in the same manner as in the developing roller C-1 except that in the developing roller C-1, the polyol was changed to a polytetramethylene glycol PTMG3000 (trade name, manufactured by Sanyo Chemical Industries, Ltd.), the isocyanate was changed to the B-2, and its blending amount was changed as shown in Table 5. Table 5 shows the elastic modulus of the surface layer of the resultant developing roller.

(Developing Roller C-14)

A developing roller C-14 was produced in the same manner as in the developing roller C-1 except that in the developing roller C-13, the isocyanate was changed to a Polymeric MDI (trade name: MILLIONATE MR-200; manufactured by Nippon Polyurethane Industry Co., Ltd.) and its blending amount was changed as shown in Table 5. Table 5 shows the elastic modulus of the surface layer of the resultant developing roller.

(Developing Roller C-15)

A developing roller C-15 was produced in the same manner as in the developing roller C-1 except that in the developing roller C-1, the polyol was changed to a polybutadiene polyol (trade name: Poly bd R-15HT; manufactured by Idemitsu Kosan Co., Ltd.), the isocyanate was changed to the B-2, and its blending amount was changed as shown in Table 5. Table 5 shows the elastic modulus of the surface layer of the resultant developing roller.

TABLE 5

| | Surface layer | | | | |
|---|---|---|---|---|---|
| | | Isocyanate | | Carbon black | |
| Developing roller No. | Polyol No. | No. | Blending amount with respect to 100 g of polyol (g) | Blending amount with respect to 100 g of polyol (g) | Elastic modulus at 5° C. (MPa) |
| C-1 | A-9 | B-4 | 6.7 | 21.2 | 300 |
| C-2 | | B-5 | 7.9 | 21.5 | 350 |
| C-3 | A-8 | B-2 | 12.7 | 22.3 | 400 |
| C-4 | A-5 | B-3 | 125.8 | 43.1 | 800 |
| C-5 | A-6 | | | | 550 |
| C-6 | A-2 | | | | 650 |
| C-7 | A-6 | B-5 | 148 | 47.5 | 150 |
| C-8 | A-1 | p-MDI | 64.9 | 22.3 | 1,000 |
| C-9 | A-1 | B-1 | 209.6 | 57.8 | 850 |
| C-10 | A-4 | B-2 | 51.6 | 29.3 | 900 |
| C-11 | A-7 | B-1 | 9.4 | 21.7 | 100 |
| C-12 | A-3 | B-1 | 69.3 | 32.5 | 500 |
| C-13 | PTMG3000 | B-2 | 82.5 | 34.9 | 1,300 |

TABLE 5-continued

| | Surface layer | | | | |
|---|---|---|---|---|---|
| | | Isocyanate | | Carbon black | |
| Developing roller No. | Polyol No. | No. | Blending amount with respect to 100 g of polyol (g) | Blending amount with respect to 100 g of polyol (g) | Elastic modulus at 5° C. (MPa) |
| C-14 | | p-MDI | 64.9 | 24.7 | 2,500 |
| C-15 | RT-15HT | B-2 | 229.7 | 61.5 | 1,700 |

That the surface layers of the resultant developing rollers each have the structure represented by the structural formula (a), and one or both of the structures selected from the structure represented by the structural formula (b) and the structure represented by the structural formula (c) can be confirmed through analysis by, for example, NMR, pyrolysis GC/MS, or FT-IR.

The surface layers of the developing rollers C-1 to C-12 were analyzed with an FT-NMR AVANCE 500 (manufactured by BRUKER), and 1H and 13C as measurement nuclei (at 25° C., in heavy chloroform, tetramethylsilane was used as a reference substance). As a result, it was confirmed that the surface layers each had the structure represented by the structural formula (a), and one or both of the structures selected from the structure represented by the structural formula (b) and the structure represented by the structural formula (c).

In addition, the surface layers of the developing rollers C-13 to C-15 were similarly analyzed. As a result, it was confirmed that the surface layers were each formed of the structure represented by the structural formula (a), and were each free of the structure represented by the structural formula (b) and the structure represented by the structural formula (c).

The toners and the developing rollers obtained as described above were evaluated for the following items.

(Evaluation for Fogging)

An evaluation for fogging was performed with the produced toners and developing rollers, and with an electrophotographic image forming apparatus. A Color LaserJet CP3520 (trade name) manufactured by Hewlett-Packard Company was used as the electrophotographic image forming apparatus. A dedicated process cartridge for a black color was used as a process cartridge, and the toner and developing roller in its developing unit were replaced with those produced in the foregoing before its preparation. At this time, 100 g of the toner were loaded.

The prepared process cartridge was mounted on the main body of the electrophotographic image forming apparatus, and was then left to stand under an environment having a temperature of 5° C. and a humidity of 10% RH for 24 hours. After that, continuous output of images each having a print percentage of 2% was repeated in the environment. Every time the images were continuously output on 1,000 sheets, a solid white image was output. The foregoing operation was repeated until the number of image-printed sheets reached 10,000, and then a fogging value was measured by the following method.

The fogging value was measured as described below. The reflection density of a recording material before image formation and the reflection density of a recording material on which the solid white image had been output were measured with a reflection densitometer TC-6DS/A (trade name, manufactured by Tokyo Denshoku CO., LTD.), and the increment between the reflection densities was defined as the fogging value of the developing roller. Reflection densities in the entirety of the image print region of a recording material were measured, an arithmetic average was adopted for the recording material before image formation, and the maximum was adopted for the recording material on which the solid white image had been output. Next, the arithmetic average of the fogging values of each of the images on up to the 10,000 sheets was calculated, and then the evaluation for fogging was performed with the value.

The smaller the fogging value, the better. A fogging value of less than 1.0 was evaluated as "A," a fogging value of 1.0 or more and less than 3.0 was evaluated as "B," a fogging value of 3.0 or more and less than 5.0 was evaluated as "C," and a fogging value of 5.0 or more was evaluated as "D."

In ordinary cases, toner is not transferred onto transfer paper on which a solid white image has been formed, and the fogging value is less than 3.0. However, when the charge quantity of the toner is insufficient, even at the time of the formation of the solid white image, the toner moves onto a photosensitive member and is then transferred onto the transfer paper, thereby causing fogging.

(Evaluation for Charge Quantity Q/M)

Next, in the same continuous output, every time the images were continuously output on 1,000 sheets, the charge quantity of the toner was measured. The foregoing operation was repeated until the number of image-printed sheets reached 10,000.

Figure 5:
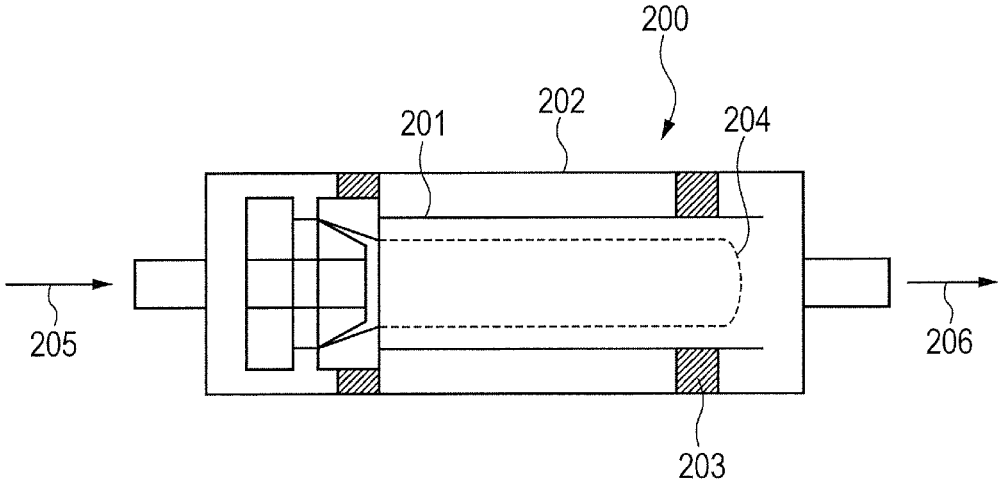
FIG. 5 is a schematic construction view illustrating an example of a Faraday cage according to the present invention.

The charge quantity of the toner was measured with a Faraday cage 200 (suction-type Faraday cage) illustrated in FIG. 5 according to the following procedure. The Faraday cage is a metallic double cylinder constituted of coaxial cylinders, and an inner cylinder 201 and an outer cylinder 202 are insulated from each other by an insulating member 203. When a charged body having an electric charge quantity Q enters the inner cylinder, electrostatic induction establishes a state just like a state where a metal cylinder having the electric charge quantity Q is present.

First, the process cartridge was forcibly pulled out of the electrophotographic image forming apparatus during its operation of forming a solid white image, and then the developing roller was stopped. Next, a toner 205 of a toner layer after its passage through a toner regulating member and before its abutment on a photosensitive member was taken in a filter paper filter 204 placed in the inner cylinder of the Faraday cage from the surface of the developing roller by air suction 206. The induced electric charge quantity Q (μC) was measured with an electrometer (trade name: 616 DIGITAL ELECTROMETER; manufactured by Keithley Instruments Inc.), and then a charge quantity Q/M (μC/g) was determined by dividing the measured value by the weight M (g) of the toner collected by the filter paper filter in the inner cylinder. Next, the arithmetic average of the respective charge quantities on up to the 10,000 sheets was calculated.

The charge quantity Q/M was used as an indicator for the degree of fogging because the larger the value for the charge quantity, the smaller the fogging value, i.e., the better.

(Evaluation for Filming)

An evaluation for filming was performed with the produced toners and developing rollers, and with an electrophotographic image forming apparatus. A Color LaserJet CP3520 (trade name) manufactured by Hewlett-Packard Company was used as the electrophotographic image forming apparatus. A dedicated process cartridge for a magenta color was used as a process cartridge, and the toner and developing roller in its developing unit were replaced with those produced in the foregoing before its preparation. At this time, 100 g of the toner were loaded. The prepared process cartridge was mounted on the main body of the electrophotographic image forming apparatus, and was then left to stand under an environment having a temperature of 5° C. and a humidity of 10% RH for 24 hours. After that, continuous output of images each having a print percentage of 1% was repeated in the environment. When the remaining amount of the toner in the developing unit reduced and an output image began to fade, the continuous output was terminated.

After that, a halftone image having a uniform density in its entire region was output and then an evaluation for density unevenness resulting from filming was performed. With regard to the density unevenness, first, the presence or absence of the density unevenness in the vicinities in the same image was evaluated with the eyes, and then the maximum of density differences in the vicinities of the density unevenness portions was measured with a reflection densitometer (trade name: GretagMacbeth RD918, manufactured by GretagMacbeth).

With regard to the density unevenness, the smaller the density difference, the better. A density difference of less than 0.05 was evaluated as "A," a density difference of 0.05 or more and less than 0.1 was evaluated as "B," a density difference of 0.1 or more and less than 0.3 was evaluated as "C," and a density difference of 0.3 or more was evaluated as "D."

(Coloring Density)

Next, the developing roller was taken out of the process cartridge while being in a state where the toner layer was formed, and then the unsticking toner on the surface of the developing roller was removed by air blowing. Next, a polyester adhesive tape (trade name: No. 31B, manufactured by Nitto Denko Corporation) was attached to the surface of the developing roller. After that, the adhesive tape was peeled off together with the toner sticking and remaining on the surface of the developing roller, and was then attached to white paper. The foregoing was performed on the entirety of the image print region of the surface of the developing roller, and then the reflection densities of the adhesive tape were measured with a reflection densitometer (trade name: TC-6DS/A, manufactured by Tokyo Denshoku CO., LTD.) for the entirety of the image print region, followed by the determination of the maximum. Next, the reflection densities of a brand-new polyester adhesive tape similarly attached to white paper were measured and then the minimum was determined. The reflection density increment between the maximum and the minimum was defined as a value for a coloring density. The coloring density was used as an indicator for the degree of filming of the developing roller because the smaller the value for the coloring density, the smaller the filming amount of the developing roller, i.e., the better.

Example 1

The evaluation for fogging and the evaluation for filming were performed with the toner (A) and the developing roller C-1, and with the electrophotographic image forming apparatus by the methods.

Examples 2 to 20

The evaluations were performed in the same manner as in Example 1 except that the toner was changed to those shown in Table 6.

Examples 20 to 31

The evaluations were performed in the same manner as in Example 1 except that the developing roller was changed to those shown in Table 6.

Examples 32 to 35

The evaluations were performed in the same manner as in Example 1 except that the toner and the developing roller were changed to those shown in Table 6.

Comparative Examples 1 to 11

The evaluations were performed in the same manner as in Example 1 except that the toner was changed to those shown in Table 6.

Comparative Examples 12 to 14

The evaluations were performed in the same manner as in Example 1 except that the developing roller was changed to those shown in Table 6. The evaluation results are collectively shown in Table 6.

TABLE 6

| | Toner No. | R(25) × $10^{-3}$ | Developing roller No. | Elastic modulus at 5° C. (MPa) | Results of evaluations | | | |
|---|---|---|---|---|---|---|---|---|
| | | | | | Fogging | Q/M (μC/g) | Filming | Coloring density |
| Example 1 | A | 1.26 | C-1 | 300 | A | 40 | A | 0.01 |
| Example 2 | B | 1.22 | | 300 | A | 35 | A | 0.02 |
| Example 3 | C | 1.19 | | 300 | A | 36 | A | 0.01 |
| Example 4 | D | 1.18 | | 300 | A | 37 | A | 0.02 |
| Example 5 | E | 0.64 | | 300 | A | 39 | B | 0.03 |
| Example 6 | F | 0.62 | | 300 | A | 38 | B | 0.04 |
| Example 7 | G | 1.18 | | 300 | A | 35 | A | 0.02 |
| Example 8 | H | 1.18 | | 300 | A | 36 | A | 0.02 |
| Example 9 | I | 1.18 | | 300 | A | 38 | A | 0.01 |
| Example 10 | J | 1.18 | | 300 | A | 36 | A | 0.02 |

TABLE 6-continued

| | Toner No. | R(25) × $10^{-3}$ | Developing roller No. | Elastic modulus at 5° C. (MPa) | Results of evaluations Fogging | Q/M (μC/g) | Filming | Coloring density |
|---|---|---|---|---|---|---|---|---|
| Example 11 | K | 1.18 | | 300 | A | 36 | A | 0.01 |
| Example 12 | L | 1.18 | | 300 | A | 38 | A | 0.02 |
| Example 13 | M | 1.18 | | 300 | A | 37 | A | 0.01 |
| Example 14 | N | 1.18 | | 300 | A | 37 | A | 0.02 |
| Example 15 | O | 1.11 | | 300 | A | 37 | A | 0.02 |
| Example 16 | P | 1.25 | | 300 | B | 35 | A | 0.01 |
| Example 17 | Q | 1.19 | | 300 | A | 38 | A | 0.02 |
| Example 18 | R | 1.21 | | 300 | A | 37 | A | 0.02 |
| Example 19 | S | 0.64 | | 300 | A | 38 | B | 0.04 |
| Example 20 | T | 0.60 | | 300 | B | 36 | B | 0.03 |
| Example 21 | A | 1.26 | C-2 | 350 | A | 40 | A | 0.02 |
| Example 22 | | 1.26 | C-3 | 400 | A | 39 | A | 0.02 |
| Example 23 | | 1.26 | C-4 | 800 | A | 37 | A | 0.01 |
| Example 24 | | 1.26 | C-5 | 550 | A | 38 | A | 0.02 |
| Example 25 | | 1.26 | C-6 | 650 | A | 38 | A | 0.01 |
| Example 26 | | 1.26 | C-7 | 150 | A | 41 | A | 0.02 |
| Example 27 | | 1.26 | C-8 | 1,000 | B | 35 | B | 0.04 |
| Example 28 | | 1.26 | C-9 | 850 | A | 37 | B | 0.03 |
| Example 29 | | 1.26 | C-10 | 900 | B | 36 | B | 0.04 |
| Example 30 | | 1.26 | C-11 | 100 | A | 42 | A | 0.02 |
| Example 31 | | 1.26 | C-12 | 500 | A | 40 | A | 0.02 |
| Example 32 | P | 1.25 | C-11 | 100 | B | 35 | A | 0.02 |
| Example 33 | P | 1.25 | C-8 | 1,000 | A | 37 | B | 0.04 |
| Example 34 | T | 0.6 | C-11 | 100 | B | 36 | A | 0.02 |
| Example 35 | T | 0.6 | C-8 | 1,000 | B | 35 | B | 0.03 |
| Comparative Example 1 | a | 0.98 | C-1 | 300 | C | 32 | C | 0.06 |
| Comparative Example 2 | b | 0.51 | | 300 | C | 33 | D | 0.08 |
| Comparative Example 3 | c | 1.66 | | 300 | C | 32 | B | 0.02 |
| Comparative Example 4 | d | 0.5 | | 300 | D | 29 | D | 0.09 |
| Comparative Example 5 | e | 1.25 | | 300 | D | 30 | C | 0.07 |
| Comparative Example 6 | f | 0.38 | | 300 | D | 29 | D | 0.08 |
| Comparative Example 7 | g | 1.2 | | 300 | D | 29 | C | 0.06 |
| Comparative Example 8 | h | 1.78 | | 300 | D | 30 | D | 0.09 |
| Comparative Example 9 | i | 1.21 | | 300 | B | 36 | C | 0.07 |
| Comparative Example 10 | j | 1.39 | | 300 | B | 35 | C | 0.07 |
| Comparative Example 11 | k | 0.72 | | 300 | D | 30 | D | 0.09 |
| Comparative Example 12 | A | 1.26 | C-13 | 1,300 | C | 32 | C | 0.07 |
| Comparative Example 13 | | 1.26 | C-14 | 2,500 | D | 29 | D | 0.10 |
| Comparative Example 14 | | 1.26 | C-15 | 1,700 | C | 33 | D | 0.09 |

It was found from the results of Examples 1 to 35 of Table 6 that the developing unit having at least the toner of (1), the developing roller of (2), and the toner regulating member was able to alleviate the occurrence of fogging due to an insufficient charge quantity of the toner in a low-temperature environment. It was also found that the developing unit was simultaneously able to alleviate the occurrence of an image harmful effect called filming in which the toner stuck to the surface of the developing roller to develop a halftone image in a partially dense manner.

Further, it was found that the elastic modulus of the surface layer of the developing roller at 5° C. was preferably set to 100 MPa or more and 1,000 MPa or less in order for the occurrence of fogging and filming to be alleviated.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-144346 filed Jun. 27, 2012, and Japanese Patent Application No. 2012-223149 filed Oct. 5, 2012, which are hereby incorporated by reference herein in their entirety.

What is claimed is:

1. A developing unit, comprising at least:

a toner of (1);

a developing roller of (2); and a toner regulating member for controlling a toner amount on a surface of the developing roller:

(1) a toner, comprising:

toner particles each containing at least a binder resin, a coloring agent, and a wax component; and an inorganic fine powder, wherein:

when a displacement amount (μm) obtained when a load is applied to one particle of the toner at a temperature of Y° C. and at a loading rate of $9.8\times10^{-5}$ N/sec, and the load is reached at a maximum load of $2.94\times10^{-4}$ N, is defined as a displacement amount $X_{2(Y)}$, a displacement amount (μm) obtained when, after the load has reached the maximum load, the particle is left to stand under the maximum load for 0.1 second, is defined as a maximum displacement amount $X_{3(Y)}$, a displacement amount (μm) obtained when, after the standing for 0.1 second, the load is reduced at an unloading rate of $9.8\times10^{-5}$ N/sec, and then the load is reached at 0 N, is defined as a displacement amount $X_{4(Y)}$, a difference between the maximum displacement amount $X_{3(Y)}$ and the displacement amount $X_{4(Y)}$, is defined as an elastic displacement amount $(X_{3(Y)}-X_{4(Y)})$, and a percentage of the elastic displacement amount $(X_{3(Y)}-X_{4(Y)})$ to the maximum displacement amount $X_{3(Y)}$, $\{(X_{3(Y)}-X_{4(Y)})/X_{3(Y)}\}\times100$, is defined as Z(Y) (%), Z(25), Z(Y) at the temperature Y is 25° C., satisfies a relationship of $40\leq Z(25)\leq80$, and Z(50), Z(Y) at the temperature Y is 50° C., satisfies a relationship of $10\leq Z(50)\leq55$;

in a load-displacement curve of which a displacement amount of the toner versus the load thereon at a temperature of 25° C. is plotted, when a gradient of the load-displacement curve from an origin to a point at which the load reaches the maximum load, is defined as R(25) (N/μm), $2.94\times10^{-4}$/displacement amount $X_{2(25)}$, R(25) satisfies a relationship of $0.49\times10^{-3}\leq R(25)\leq1.70\times10^{-3}$;

having a glass transition temperature (TgA) of 40° C. or more and 60° C. or less, and a peak temperature (P1) of a maximum endothermic peak of 70° C. or more and 110° C. or less; and satisfying a relationship of 15° C.≤(P1−TgA)≤70° C.; and (2) a developing roller, comprising:

a mandrel;

an elastic layer formed on a periphery of the mandrel; and a surface layer containing a urethane resin, the surface layer coating a peripheral surface of the elastic layer, wherein the urethane resin has, between two adjacent urethane bonds, a structure represented by the following structural formula (a), and one or both of structures selected from a structure represented by the following structural formula (b) and a structure represented by the following structural formula (c)

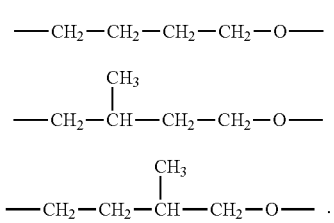

Structural formula (a)

Structural formula (b)

Structural formula (c)

2. The developing unit according to claim 1, wherein the surface layer of the developing roller has an elastic modulus at 5° C. of 100 MPa or more and 1,000 MPa or less.

3. The developing unit according to claim 1, wherein the elastic layer of the developing roller comprises an elastic layer containing a cured substance of an addition-curing-type dimethyl silicone rubber.

4. The developing unit according to claim 1, wherein the toner particles comprise toner particles obtained by dispersing, in an aqueous dispersion medium, a polymerizable monomer composition containing at least a polymerizable monomer to be used in production of the binder resin, the coloring agent, and the wax component, granulating and polymerizing the polymerizable monomer.

5. An electrophotographic image forming apparatus, comprising:

an image bearing member for bearing an electrostatic latent image;

a charging unit for charging the image bearing member;

an exposing unit for forming the electrostatic latent image on the charged image bearing member;

a developing unit for developing the electrostatic latent image with toner to form a toner image; and a transferring unit for transferring the toner image onto a transfer material, wherein the developing unit comprises the developing unit according to claim 1.

* * * * *